US009462845B2

(12) United States Patent
Auger et al.

(10) Patent No.: US 9,462,845 B2
(45) **Date of Patent: *Oct. 11, 2016**

(54) COMPOSITE SOLE STRUCTURE

(71) Applicant: NIKE, Inc., Beaverton, OR (US)

(72) Inventors: Perry W. Auger, Tigard, OR (US); Andrew Caine, Portland, OR (US); Sergio Cavaliere, Venice (IT)

(73) Assignee: NIKE, Inc., Beaverton, OR (US)

( * ) Notice: Subject to any disclaimer, the term of this patent is extended or adjusted under 35 U.S.C. 154(b) by 310 days.

This patent is subject to a terminal disclaimer.

(21) Appl. No.: 14/225,701

(22) Filed: Mar. 26, 2014

(65) Prior Publication Data

US 2014/0338230 A1 Nov. 20, 2014

Related U.S. Application Data

(62) Division of application No. 13/009,549, filed on Jan. 19, 2011, now Pat. No. 8,713,819.

(51) Int. Cl.
*A43B 13/12* (2006.01)
*A43B 13/14* (2006.01)
(Continued)

(52) U.S. Cl.
CPC ..... *A43B 13/141* (2013.01); *A43B 1/0009* (2013.01); *A43B 5/02* (2013.01); *A43B 13/026* (2013.01); *A43B 13/12* (2013.01);
(Continued)

(58) Field of Classification Search
CPC ..... A43B 13/00; A43B 13/12; A43B 13/14
USPC ..... 36/25 R, 30 R, 31, 67 R, 127–129, 134, 36/15, 102, 107, 76 R, 81
See application file for complete search history.

(56) References Cited

U.S. PATENT DOCUMENTS

D15,185 S 8/1884 Brooks
830,324 A 9/1906 Hunt
(Continued)

FOREIGN PATENT DOCUMENTS

CA 2526727 5/2007
CN 1829455 9/2006
(Continued)

OTHER PUBLICATIONS

Chinese Application No. 201510599844.7, filed Sep. 18, 2015.
(Continued)

*Primary Examiner* — Marie Bays
(74) *Attorney, Agent, or Firm* — Plumsea Law Group, LLC

(57) ABSTRACT

Embodiments relating to a lightweight sole structure are disclosed. In some embodiments, the sole structure may include a lobed member having a protruding portion associated with a cleat member. In some embodiments, the sole structure may include a chambered member located in an indention in an intermediate member. In some embodiments, the sole structure may include a cleat member having an outer layer, an intermediate layer, and an inner layer. In some embodiments, a method of making a sole structure may include injecting a chambered member in between an upper member and an intermediate member. In some embodiments, the sole structure may include a plurality of zones having varying degrees of flexibility. In some embodiments, the sole structure may include cleat members having penetrating portions for penetrating into the ground surface.

18 Claims, 15 Drawing Sheets

(51) Int. Cl.

| | |
|---|---|
| ***A43B 5/02*** | (2006.01) |
| ***A43B 13/02*** | (2006.01) |
| ***A43B 13/26*** | (2006.01) |
| ***A43B 1/00*** | (2006.01) |
| ***A43D 29/00*** | (2006.01) |
| ***A43C 15/02*** | (2006.01) |

(52) U.S. Cl.

CPC ..... *A43B 13/125* (2013.01); *A43B 13/26* (2013.01); *A43C 15/02* (2013.01); *A43D 29/00* (2013.01)

(56) References Cited

U.S. PATENT DOCUMENTS 1,087,212 A 2/1914 Caldwell
1,361,078 A 12/1920 Lynn
D81,917 S 9/1930 Burchfield
2,087,945 A 7/1937 Butler
2,095,095 A 10/1937 Howard
2,185,397 A 1/1940 Birchfield
D171,130 S 12/1953 Gruner
3,043,026 A 7/1962 Semon
3,063,171 A 11/1962 Hollander
D201,865 S 8/1965 Bingham, Jr. et al.
3,328,901 A 7/1967 Strickland
3,341,952 A 9/1967 Dassler
3,352,034 A 11/1967 Braun
D213,416 S 3/1969 Dittmar et al.
3,481,820 A 12/1969 Jonas
D219,503 S 12/1970 Vietas
3,597,863 A 8/1971 Austin et al.
3,619,916 A 11/1971 Neri
3,631,614 A 1/1972 Rice
3,656,245 A 4/1972 Wilson
3,718,996 A 3/1973 Austin
3,775,874 A 12/1973 Bonneville
3,793,750 A * 2/1974 Bowerman ..... A43B 1/04 36/129
3,898,751 A 8/1975 Gustin
3,951,407 A 4/1976 Calacurcio
4,096,649 A 6/1978 Saurwein
4,107,858 A 8/1978 Bowerman et al.
4,146,979 A 4/1979 Fabbrie
4,245,406 A * 1/1981 Landay ..... A43B 5/00 264/244
4,315,374 A 2/1982 Sneeringer
4,335,530 A 6/1982 Stubblefield
4,347,674 A 9/1982 George
4,375,728 A 3/1983 Dassler
4,375,729 A 3/1983 Buchanen, III
4,392,312 A 7/1983 Crowley et al.
D271,159 S 11/1983 Muller-Feigelstock
D272,200 S 1/1984 Autry et al.
D272,772 S 2/1984 Kohno
4,454,662 A 6/1984 Stubblefield
D278,759 S 5/1985 Norton et al.
4,574,498 A 3/1986 Norton et al.
4,586,274 A 5/1986 Blair
4,594,799 A * 6/1986 Lin ..... A43B 5/00 36/114
D287,662 S 1/1987 Tonkel
4,633,600 A 1/1987 Dassler et al.
4,667,425 A 5/1987 Effler et al.
4,674,200 A 6/1987 Sing
4,689,901 A 9/1987 Ihlenburg
4,698,923 A 10/1987 Arff
4,715,133 A 12/1987 Hartjes et al.
D294,655 S 3/1988 Heyes
D295,231 S 4/1988 Heyes
4,833,796 A 5/1989 Flemming
4,858,343 A 8/1989 Flemming
4,873,774 A 10/1989 Lafever
5,025,573 A 6/1991 Giese et al.
D322,510 S 12/1991 Miller
5,084,987 A * 2/1992 Flemming ..... A43B 1/0009 36/28
5,174,049 A 12/1992 Flemming
5,201,126 A 4/1993 Tanel
5,221,379 A 6/1993 Nicholas
D339,459 S 9/1993 Yoshikawa et al.
5,289,647 A 3/1994 Mercer
5,299,369 A 4/1994 Goldman
5,335,429 A 8/1994 Hansen
5,339,544 A 8/1994 Caberlotto
5,351,422 A 10/1994 Fitzgerald
5,367,791 A 11/1994 Gross et al.
5,384,973 A 1/1995 Lyden
5,406,723 A 4/1995 Okajima
5,410,823 A 5/1995 Lyoob
5,452,526 A 9/1995 Collins
5,461,801 A 10/1995 Anderton
5,473,827 A 12/1995 Barre et al.
D368,156 S 3/1996 Longbottom et al.
D368,360 S 4/1996 Wolfe
D369,672 S 5/1996 Tanaka et al.
5,513,451 A 5/1996 Kataoka et al.
5,526,589 A 6/1996 Jordan
5,555,650 A 9/1996 Longbottom et al.
5,572,807 A 11/1996 Kelly et al.
5,617,653 A 4/1997 Walker et al.
5,634,283 A 6/1997 Kastner
D387,892 S 12/1997 Briant
D389,298 S 1/1998 Briant
5,709,954 A 1/1998 Lyden et al.
D394,943 S 6/1998 Campbell et al.
5,775,010 A 7/1998 Kaneko
5,806,209 A 9/1998 Crowley et al.
5,815,951 A 10/1998 Jordan
5,829,172 A 11/1998 Kaneko
5,832,636 A 11/1998 Lyden et al.
5,839,208 A * 11/1998 Huang ..... A43B 13/20 36/28
5,887,371 A 3/1999 Curley, Jr.
5,915,820 A 6/1999 Kraeuter et al.
5,946,828 A 9/1999 Jordan et al.
5,956,871 A 9/1999 Korsen
D415,340 S 10/1999 McMullin
5,979,083 A 11/1999 Robinson et al.
5,983,529 A 11/1999 Serna
5,987,783 A 11/1999 Allen et al.
6,016,613 A 1/2000 Campbell et al.
D421,833 S 3/2000 Fallon
6,035,559 A 3/2000 Freed et al.
6,065,229 A * 5/2000 Wahrheit ..... A43B 13/12 36/25 R
6,079,127 A 6/2000 Nishimura et al.
D427,754 S 7/2000 Portaud
6,101,746 A 8/2000 Evans
6,112,433 A 9/2000 Greiner
6,125,556 A 10/2000 Peckler et al.
6,145,221 A 11/2000 Hockerson
6,161,315 A 12/2000 Dalton
D437,108 S 2/2001 Peabody
D437,989 S 2/2001 Cass
6,199,303 B1 3/2001 Luthi et al.
6,231,946 B1 5/2001 Brown, Jr. et al.
6,256,907 B1 7/2001 Jordan et al.
6,321,469 B1 * 11/2001 Cretinon ..... A43B 13/10 36/102
6,357,146 B1 3/2002 Wordsworth et al.
6,389,714 B1 5/2002 Mack
D461,297 S 8/2002 Lancon
6,481,122 B2 11/2002 Brahler
D468,517 S 1/2003 Recchi et al.
6,550,160 B2 4/2003 Miller, II
6,564,476 B1 * 5/2003 Hernandez ..... A43B 1/0009 36/103
D477,905 S 8/2003 Adams et al.
D478,714 S 8/2003 Recchi
6,647,647 B2 11/2003 Auger et al.
6,675,505 B2 1/2004 Terashima
6,698,110 B1 3/2004 Robbins
6,708,427 B2 3/2004 Sussmann et al.

(56) References Cited

U.S. PATENT DOCUMENTS 6,725,574 B2 4/2004 Hokkirigawa et al.
6,739,075 B2 5/2004 Sizemore
6,754,984 B2 6/2004 Schaudt et al.
D495,122 S 8/2004 McMullin
6,834,446 B2 12/2004 McMullin
6,892,479 B2 5/2005 Auger et al.
6,904,707 B2 6/2005 McMullin
6,915,595 B2 7/2005 Kastner
6,915,596 B2 7/2005 Grove et al.
6,935,055 B2 8/2005 Oorei
6,941,684 B2 9/2005 Auger et al.
6,954,998 B1 10/2005 Lussier
6,968,637 B1 11/2005 Johnson
6,973,745 B2 12/2005 Mills et al.
6,973,746 B2 12/2005 Auger et al.
7,007,410 B2 3/2006 Auger et al.
D525,416 S 7/2006 Auger et al.
7,143,530 B2 12/2006 Hudson et al.
7,181,868 B2 2/2007 Auger et al.
7,194,826 B2 3/2007 Ungari
7,234,250 B2 6/2007 Fogarty et al.
7,254,909 B2 8/2007 Ungari
7,269,916 B2 9/2007 Biancucci et al.
D553,336 S 10/2007 McMullin
7,287,343 B2 10/2007 Healy
7,370,439 B1 5/2008 Myers
D571,092 S 6/2008 Norton
D571,542 S 6/2008 Wilken
7,386,948 B2 6/2008 Sink
D573,779 S 7/2008 Stauffer
7,401,418 B2 7/2008 Wyszynski et al.
D575,041 S 8/2008 Wilken
7,406,781 B2 8/2008 Scholz
7,409,783 B2 8/2008 Chang
D578,280 S 10/2008 Wilken
7,430,819 B2 10/2008 Auger et al.
7,441,350 B2 10/2008 Auger et al.
7,490,418 B2 2/2009 Obeydani
7,536,810 B2 5/2009 Jau et al.
7,559,160 B2 7/2009 Kelly
7,584,554 B2 9/2009 Fogarty et al.
7,610,695 B2 11/2009 Hay
7,650,707 B2 1/2010 Campbell et al.
7,654,013 B2 2/2010 Savoie et al.
7,665,229 B2 2/2010 Kilgore et al.
7,673,400 B2 3/2010 Brown et al.
7,685,741 B2 3/2010 Friedman
7,685,745 B2 3/2010 Kuhtz et al.
7,707,748 B2 5/2010 Campbell
7,762,009 B2 7/2010 Gerber
7,784,196 B1 8/2010 Christensen et al.
7,827,705 B2 11/2010 Baucom et al.
7,866,064 B2 1/2011 Gerber
D632,466 S 2/2011 Kasprzak
D635,338 S 4/2011 Favreau et al.
8,079,160 B2 12/2011 Baucom et al.
8,122,617 B1 2/2012 Dixon et al.
8,256,145 B2 9/2012 Baucom et al.
8,322,051 B2 12/2012 Auger et al.
8,356,428 B2 1/2013 Auger et al.
8,453,354 B2 6/2013 Baker
8,533,979 B2 9/2013 Baker
8,713,819 B2 * 5/2014 Auger ..... A43B 5/02 36/102
2002/0017036 A1 2/2002 Berger et al.
2002/0062578 A1 5/2002 Lussier et al.
2002/0069559 A1 6/2002 Gee
2002/0078603 A1 6/2002 Schmitt, Jr.
2002/0100190 A1 8/2002 Pellerin
2002/0144429 A1 10/2002 Hay
2002/0166262 A1 11/2002 Hernandez
2002/0178619 A1 12/2002 Schaudt et al.
2003/0019127 A1 1/2003 Parisotto
2003/0033731 A1 2/2003 Sizemore
2003/0188458 A1 10/2003 Kelly
2004/0000075 A1 1/2004 Auger et al.
2004/0035024 A1 2/2004 Kao
2004/0098881 A1 5/2004 Flavio et al.
2004/0187356 A1 9/2004 Patton
2004/0250451 A1 12/2004 McMullin
2005/0016029 A1 1/2005 Auger et al.
2005/0072026 A1 4/2005 Sink
2005/0097783 A1 5/2005 Mills et al.
2005/0108898 A1 5/2005 Jeppesen et al.
2005/0120593 A1 6/2005 Mason
2005/0217149 A1 10/2005 Ho
2005/0257405 A1 11/2005 Kilgore
2005/0268490 A1 12/2005 Foxen
2006/0016101 A1 1/2006 Ungari
2006/0021254 A1 2/2006 Jones
2006/0021255 A1 2/2006 Auger et al.
2006/0021259 A1 2/2006 Wood et al.
2006/0042124 A1 3/2006 Mills et al.
2006/0064905 A1 3/2006 Hudson et al.
2006/0090373 A1 5/2006 Savoie et al.
2006/0130372 A1 6/2006 Auger et al.
2006/0168847 A1 8/2006 Myers et al.
2006/0242863 A1 11/2006 Patmore
2007/0039209 A1 2/2007 White et al.
2007/0199211 A1 8/2007 Campbell
2007/0199213 A1 8/2007 Campbell et al.
2007/0209230 A1 9/2007 Dillon et al.
2007/0261271 A1 11/2007 Krouse
2007/0266597 A1 11/2007 Jones
2008/0010863 A1 1/2008 Auger et al.
2008/0066348 A1 3/2008 O'Brien et al.
2008/0098624 A1 5/2008 Goldman
2008/0196276 A1 8/2008 McMullin
2008/0216352 A1 9/2008 Baucom et al.
2008/0282579 A1 11/2008 Bobbett et al.
2009/0019732 A1 1/2009 Sussmann
2009/0056169 A1 3/2009 Robinson, Jr. et al.
2009/0056172 A1 3/2009 Cho
2009/0100716 A1 4/2009 Gerber
2009/0100718 A1 4/2009 Gerber
2009/0113758 A1 5/2009 Nishiwaki et al.
2009/0113765 A1 5/2009 Robinson, Jr. et al.
2009/0126230 A1 5/2009 McDonald et al.
2009/0211118 A1 8/2009 Krikorian et al.
2009/0223088 A1 9/2009 Krikorian et al.
2009/0235558 A1 9/2009 Auger et al.
2009/0241370 A1 10/2009 Kimura
2009/0241377 A1 10/2009 Kita et al.
2009/0272008 A1 11/2009 Nomi et al.
2009/0293315 A1 12/2009 Auger et al.
2009/0307933 A1 12/2009 Leach
2010/0050471 A1 3/2010 Kim
2010/0077635 A1 4/2010 Baucom et al.
2010/0083541 A1 4/2010 Baucom et al.
2010/0126044 A1 * 5/2010 Davis ..... A43B 1/0009 36/108
2010/0199523 A1 8/2010 Mayden et al.
2010/0212190 A1 8/2010 Schmid
2010/0229427 A1 9/2010 Campbell et al.
2010/0251578 A1 10/2010 Auger et al.
2010/0313447 A1 12/2010 Becker et al.
2011/0047830 A1 3/2011 Francello et al.
2011/0078922 A1 4/2011 Cavaliere et al.
2011/0078927 A1 4/2011 Baker
2011/0088287 A1 4/2011 Auger et al.
2011/0126426 A1 6/2011 Amark
2011/0167676 A1 7/2011 Benz et al.
2011/0197475 A1 8/2011 Weidl et al.
2011/0197478 A1 8/2011 Baker
2011/0203136 A1 8/2011 Auger et al.
2012/0180343 A1 * 7/2012 Auger ..... A43B 5/02 36/30 R
2013/0067765 A1 3/2013 Auger et al.
2013/0067772 A1 3/2013 Auger et al.
2013/0067773 A1 3/2013 Auger et al.
2013/0067774 A1 3/2013 Auger et al.
2013/0067776 A1 3/2013 Auger et al.
2013/0067778 A1 3/2013 Minami
2013/0340291 A1 12/2013 Auger et al.

(56) References Cited

U.S. PATENT DOCUMENTS

| | | | |
|---|---|---|---|
| 2013/0340296 | A1 | 12/2013 | Auger et al. |
| 2014/0026441 | A1 | 1/2014 | Stauffer |
| 2014/0026444 | A1 | 1/2014 | Howley et al. |
| 2014/0331418 | A1 | 11/2014 | Auger et al. |

FOREIGN PATENT DOCUMENTS

| | | |
|---|---|---|
| DE | 930798 | 7/1955 |
| DE | 1809860 | 4/1960 |
| DE | 3046811 | 7/1982 |
| DE | 3135347 | 3/1983 |
| DE | 3245182 | 5/1983 |
| DE | 3600525 | 10/1987 |
| DE | 3644812 | 6/1988 |
| DE | 3706069 | 9/1988 |
| DE | 4417563 | 11/1995 |
| DE | 19817579 | 10/1999 |
| EP | 115663 | 8/1984 |
| EP | 123550 | 10/1984 |
| EP | 0223700 | 5/1987 |
| EP | 340053 | 11/1989 |
| EP | 0723745 | 7/1996 |
| EP | 1025771 | 8/2000 |
| EP | 1714571 | 10/2006 |
| EP | 1839511 | 10/2007 |
| EP | 2057913 | 5/2009 |
| EP | 2499928 | 9/2012 |
| FR | 1554061 | 1/1969 |
| FR | 2567004 | 1/1986 |
| FR | 2818876 | 7/2002 |
| GB | 1329314 | 9/1973 |
| GB | 2020161 | 11/1979 |
| GB | 2113971 | 8/1983 |
| GB | 2256784 | 12/1992 |
| GB | 2377616 | 1/2003 |
| GB | 2425706 | 11/2006 |
| JP | 10000105 | 1/1998 |
| JP | 10066605 | 3/1998 |
| JP | 11276204 | 10/1999 |
| JP | 2002272506 | 9/2002 |
| JP | 2002306207 | 10/2002 |
| JP | 2004024811 | 1/2004 |
| JP | 2005185303 | 7/2005 |
| JP | 2005304653 | 11/2005 |
| TW | 540323 | 7/2003 |
| TW | M267886 | 6/2005 |
| WO | 0053047 | 9/2000 |
| WO | 03045182 | 6/2003 |
| WO | 03071893 | 9/2003 |
| WO | 2006103619 | 10/2006 |
| WO | 2008069751 | 6/2008 |
| WO | 2008128712 | 10/2008 |
| WO | 2009110822 | 9/2009 |
| WO | 2010036988 | 4/2010 |
| WO | 2010057207 | 5/2010 |
| WO | 2012150971 | 11/2012 |
| WO | 2013039701 | 3/2013 |
| WO | 2013039702 | 3/2013 |
| WO | 2013039703 | 3/2013 |
| WO | 2013039704 | 3/2013 |
| WO | 2013058874 | 4/2013 |

OTHER PUBLICATIONS

International Search Report and Written Opinion for PCT/US2011/022841 dated Apr. 15, 2011.
International Search Report and Written Opinion for PCT/US2011/022848 dated Jun. 20, 2011.
Aug. 12, 2010, Icebug Web Page (date based on information from Internet Archive).
Dec. 23, 2008, Icebug Web Page (date based on information from Internet Archive).
Invitation to Pay Additional Fees and, Where Applicable, Protest Fee mailed Jan. 7, 2013 in International Application No. PCT/US2012/052968.
Invitation to Pay Additional Fees and, Where Applicable, Protest Fee mailed Jan. 8, 2013 in International Application No. PCT/US2012/052970.
Invitation to Pay Additional Fees and, Where Applicable, Protest Fee mailed Jan. 7, 2013 in International Application No. PCT/US2012/052965.
International Search Report and Written Opinion mailed Jan. 22, 2013 in International Application No. PCT/US2012/052972.
Invitation to Pay Additional Fees and, Where Applicable, Protest Fee mailed Feb. 8, 2013 in International Application No. PCT/US2012/052963.
International Search Report and Written Opinion mailed Mar. 8, 2013 in International Application No. PCT/US2012/052965.
International Search Report and Written Opinion mailed Mar. 8, 2013 in International Application No. PCT/US2012/052968.
International Search Report and Written Opinion mailed Mar. 8, 2013 in International Application No. PCT/US2012/052970.
International Search Report and Written Opinion mailed Jul. 4, 2013, in International Patent Application PCT/US2012/052963.
International Preliminary Report on Patentability (including Written Opinion of the ISA) mailed Aug. 1, 2013 in International Application No. PCT/US2012/021663.
Restriction Requirement mailed Jul. 17, 2013 in U.S. Appl. No. 13/234,182.
Response to Restriction Requirement filed Aug. 15, 2013 in U.S. Appl. No. 13/234,182.
Office Action mailed Sep. 23, 2013 in U.S. Appl. No. 13/234,182.
Response to Office Action filed Dec. 23, 2013 in U.S. Appl. No. 13/234,182.
Interview Summary mailed Jan. 2, 2014 in U.S. Appl. No. 13/234,182.
Final Office Action mailed Feb. 4, 2014 in U.S. Appl. No. 13/234,182.
Interview Summary mailed Mar. 28, 2014 in U.S. Appl. No. 13/234,182.
Response to Final Office Action filed May 5, 2014 in U.S. Appl. No. 13/234,182.
Request for Continued Examination filed May 5, 2014 in U.S. Appl. No. 13/234,182.
Office Action mailed Jun. 4, 2014 in U.S. Appl. No. 13/234,182.
Restriction Requirement mailed Aug. 1, 2013 in U.S. Appl. No. 13/234,185.
Response to Restriction Requirement filed Aug. 29, 2013 in U.S. Appl. No. 13/234,185.
Office Action mailed Sep. 26, 2013 in U.S. Appl. No. 13/234,185.
Response to Office Action filed Dec. 26, 2013 in U.S. Appl. No. 13/234,185.
Interview Summary mailed Jan. 2, 2014 in U.S. Appl. No. 13/234,185.
Final Office Action mailed Mar. 6, 2014 in U.S. Appl. No. 13/234,185.
Interview Summary mailed May 2, 2014 in U.S. Appl. No. 13/234,185.
Response to Final Office Action filed May 30, 2014 in U.S. Appl. No. 13/234,185.
Request for Continued Examination filed May 30, 2014 in U.S. Appl. No. 13/234,185.
Restriction Requirement mailed Jul. 18, 2013 in U.S. Appl. No. 13/234,180.
Response to Restriction Requirement filed Aug. 15, 2013 in U.S. Appl. No. 13/234,180.
Office Action mailed Sep. 23, 2013 in U.S. Appl. No. 13/234,180.
Response to Office Action filed Dec. 23, 2013 in U.S. Appl. No. 13/234,180.
Interview Summary mailed Jan. 2, 2014 in U.S. Appl. No. 13/234,180.
Notice of Allowance mailed Apr. 11, 2014 in U.S. Appl. No. 13/234,180.
Restriction Requirement mailed Aug. 12, 2013 in U.S. Appl. No. 13/234,244.

(56) References Cited

OTHER PUBLICATIONS

Response to Restriction Requirement filed Aug. 29, 2013 in U.S. Appl. No. 13/234,244.
Office Action mailed Sep. 26, 2013 in U.S. Appl. No. 13/234,244.
Response to Office Action filed Dec. 26, 2013 in U.S. Appl. No. 13/234,244.
Interview Summary mailed Jan. 2, 2014 in U.S. Appl. No. 13,234,244.
Final Office Action mailed Feb. 27, 2014 in U.S. Appl. No. 13/234,244.
Interview Summary mailed Apr. 22, 2014 in U.S. Appl. No. 13/234,244.
Response to Final Office Action filed May 27, 2014 in U.S. Appl. No. 13/234,244.
Advisory Action mailed Jun. 4, 2014 in U.S. Appl. No. 13/234,244.
Request for Continued Examination filed Jun. 20, 2014 in U.S. Appl. No. 13/234,244.
Response to Written Opinion and Voluntary Amendments filed Mar. 10, 2014 in European Patent Application No. 12 709 407.6.
Voluntary Amendments filed Apr. 21, 2014 in Chinese Patent Application No. 20280005769.1.
International Search Report and Written Opinion mailed Jun. 13, 2012 in International Application No. PCT/US2012/021663.
Office Action mailed Jun. 13, 2012 in U.S. Appl. No. 12/582,252.
Response to Office Action filed Sep. 12, 2012 in U.S. Appl. No. 12/582,252.
Notice of Allowance mailed Sep. 20, 2012 in U.S. Appl. No. 12/582,252.
International Search Report for PCT/US2010/050637 dated Jan. 14, 2011.
Partial Search Report for PCT/US2009/058522 dated Mar. 4, 2010.
International Search Report for PCT/US2009/058522 dated Feb. 17, 2010.
International Search Report for PCT/US2010/029640 dated May 17, 2010.
International Search Report and Written Opinion for PCT/US2011/045356 dated Dec. 16, 2011.
First Office Action in Chinese Patent Application No. 201280005769.1 dated Jan. 28, 2015, and English translation thereof.
Response filed Jun. 12, 2015 in Chinese Patent Application No. 201280005769.1, and English translation thereof.

* cited by examiner

COMPOSITE SOLE STRUCTURE

CROSS-REFERENCE TO RELATED APPLICATIONS

This application is a divisional of Auger et al., U.S. Patent Application Publication No. 2012/0180343, published on Jul. 19, 2012 and entitled "Composite Sole Structure," the entire disclosure of which is incorporated herein by reference.

BACKGROUND

The current embodiments relate to the field of articles of footwear. More specifically, the current embodiments relate to a sole structure for articles of footwear.

Articles of footwear including various types of materials and sole structures have previously been proposed. For example, some articles of footwear may include materials forming a rigid sole structure, while other articles of footwear may include materials forming a flexible sole structure. However, a sole structure that is substantially rigid in some regions, while remaining flexible in other regions, may increase the wearer's ability to accelerate and/or change directions. In addition, a sole structure having components made of materials having varying configurations, thicknesses and lengths throughout the sole structure may reduce the overall weight of the article of footwear and enhance the performance of the wearer.

SUMMARY

Embodiments relating to a lightweight sole structure are disclosed. In some embodiments, the sole structure may include a lobed member having a protruding portion associated with a cleat member. In some embodiments, the sole structure may include a chambered member located in an indention in an intermediate member. In some embodiments, the sole structure may include a cleat member having an outer layer, an intermediate layer, and an inner layer. In some embodiments, a method of making a sole structure may include injecting a chambered member in between an upper member and an intermediate member. In some embodiments, the sole structure may include a plurality of zones having varying degrees of flexibility. In some embodiments, the sole structure may include cleat members having penetrating portions for penetrating into the ground surface.

In one aspect, a sole structure is disclosed. In one embodiment, the sole structure may include a bottom member having a top surface, a bottom surface, a forefoot region, a midsole region and a heel region, wherein the top surface of the forefoot region of the bottom member has a first protruding portion associated with a cleat member. In one embodiment, the sole structure may also include an intermediate member having a first projection, second projection, and third projection, the intermediate member further having a top surface, a bottom surface, a forefoot region, a midsole region and a heel region. In one embodiment, the first projection and second projection may be located in the forefoot region of the intermediate member and the third projection may extend through the midsole region into the heel region of the intermediate member. In one embodiment, the bottom surface of the first projection may have a second protruding portion associated with the cleat member. In one embodiment, the second protruding portion in the bottom surface of the first projection associates with the first protruding portion in the top surface of the bottom member.

In another aspect, a sole structure is disclosed. In one embodiment, the sole structure may include a bottom member having a top surface and a bottom surface. In one embodiment, the sole structure may also include an intermediate member having a top surface and a bottom surface, the intermediate member having an indentation that is concave relative to the top surface of the intermediate member, and the bottom surface of the intermediate member is attached to the top surface of the bottom member. In one embodiment, the sole structure may also include a chambered member configured to be inserted within the indentation on the top surface of the intermediate member.

In another aspect, a sole structure is disclosed. In one embodiment, the sole structure may include a bottom member having a bottom surface. In one embodiment, the sole structure may also include a cleat member associated with the bottom member, the cleat member having an outer layer, an intermediate layer, and an inner layer.

In another aspect, a method of making a sole structure is disclosed. In one embodiment, the method may include forming an upper member, wherein the upper member having a top surface, and a bottom surface. In one embodiment, the method may also include forming an intermediate member, wherein the intermediate member having a top surface and a bottom surface, wherein the top surface of the intermediate member includes a concave indentation. In one embodiment, the method may also include placing the top surface of the intermediate member in contact with the bottom surface of the upper member. In one embodiment, the method may also include injecting a chambered member into the indentation of the intermediate member, the chambered member having a honeycomb volume.

In another aspect, an article of footwear is disclosed. In one embodiment, the article of footwear may include a sole structure having a forefoot region, a midfoot region and a heel region, wherein the sole structure includes a plurality of layers. In one embodiment, the plurality of layers may include a first zone of flexibility located in the forefoot region. In one embodiment, the plurality of layers may also include a second zone of flexibility located in the forefoot region, wherein the second zone of flexibility is more rigid than the first zone of flexibility. In one embodiment, the plurality of layers may also include a third zone of flexibility located in the midfoot region, wherein the third zone of flexibility is more rigid than the first and second zone of flexibility.

In another aspect, a sole structure is disclosed. In one embodiment, the sole structure may include a bottom member having a forefoot region, midfoot region, heel region, to surface and bottom surface, the bottom surface of the bottom member forming an outer surface of the sole structure. In one embodiment, the sole structure may also include a cleat member extending from the bottom member, the cleat member including a penetrating portion that is configured to penetrate into a ground surface. In one embodiment, the sole structure may also include an intermediate member having a top surface and a bottom surface, the intermediate member configured to provide structural support for the sole structure. In one embodiment, the bottom surface of the intermediate member associates with the top surface of the bottom member, wherein a portion of the intermediate member extends into the penetrating portion of the cleat member.

In another aspect, a sole structure is disclosed. In one embodiment, the sole structure may include an upper member having a top surface and a bottom surface, the upper member having a first concave indentation in the top surface and a corresponding convex indentation extending from the bottom surface of the upper member. In one embodiment, the sole structure may also include an intermediate member having a top surface, the intermediate member having a second concave indentation in the top surface of the intermediate member, wherein the second concave indentation in the top surface of the intermediate member is configured to receive the convex indentation extending from the bottom surface of the upper member. In one embodiment, the sole structure may also include a chambered member configured to be inserted within the first concave indentation in the top surface of the upper member.

Other systems, methods, features and advantages of the current embodiments will be, or will become, apparent to those in the art upon examination of the following figures and detailed description. It is intended that all such additional systems, methods, features and advantages be included within this description and this summary, be within the scope of the current embodiments, and be protected by the following claims.

BRIEF DESCRIPTION OF THE DRAWINGS

The current embodiments can be better understood with reference to the following drawings and description. The components in the figures are not necessarily to scale, emphasis instead being placed upon illustrating the principles of the current embodiments. Moreover, in the figures, like reference numerals designate corresponding parts throughout the different views.

DETAILED DESCRIPTION

Conventional articles of athletic footwear include two primary elements, an upper and a sole structure. The upper may provide a covering for the foot that comfortably receives and securely positions the foot with respect to the sole structure. The sole structure may be secured to a lower portion of the upper and may be generally positioned between the foot and the ground. In addition to attenuating ground reaction forces (i.e., providing cushioning) during walking, running, and other ambulatory activities, the sole structure may influence foot motions (e.g., by resisting pronation), impart stability, allow for twisting and bending, and provide traction, for example. Accordingly, the upper and the sole structure may operate cooperatively to provide a comfortable structure that is suited for a wide variety of athletic activities.

The upper may be formed from a plurality of material elements (e.g., textiles, polymer sheets, foam layers, leather, synthetic leather) that may be stitched or adhesively bonded together to form a void on the interior of the footwear for comfortably and securely receiving a foot. More particularly, the upper may form a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter.

Figure 1:
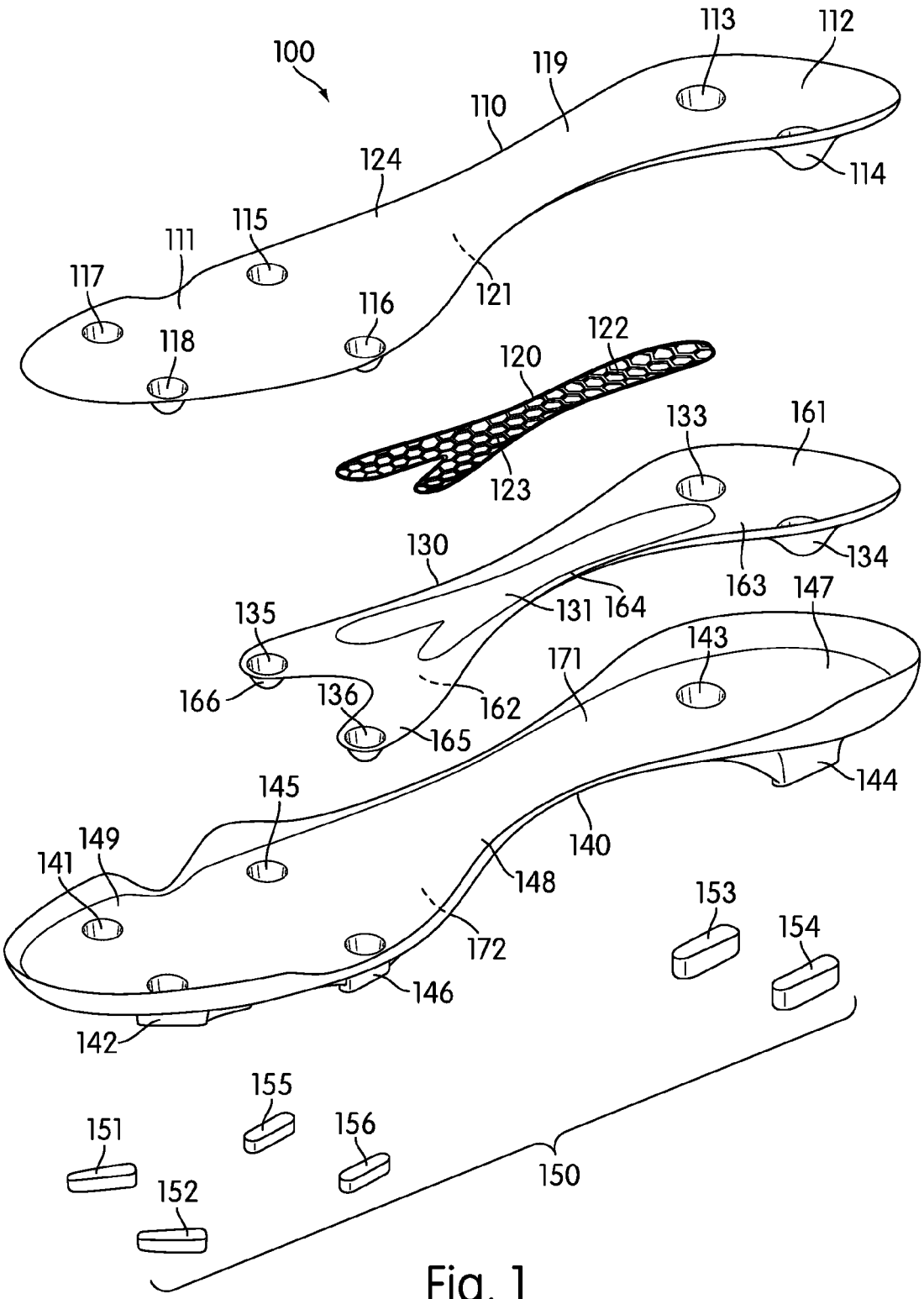
FIG. 1 is an exploded isometric view of one embodiment of a sole structure.

FIG. 1 illustrates an exploded isometric view of an embodiment of sole structure 100. The following discussion and accompanying figures disclose an article of footwear having a sole structure 100 forming a plate that includes, for example, an upper member, an intermediate member, a chambered member, and a bottom member. The article of footwear is disclosed as having a general configuration suitable for soccer or football. Concepts associated with the footwear may also be applied to a variety of other athletic footwear types, including running shoes, baseball shoes, basketball shoes, cross-training shoes, cycling shoes, football shoes, golf shoes, tennis shoes, walking shoes, and hiking shoes and boots, for example. The concepts may also be applied to footwear types that are generally considered to be non-athletic, including dress shoes, loafers, sandals, and work boots. Accordingly, the concepts disclosed herein apply to a wide variety of footwear types.

In some embodiments, the sole structure 100 may be associated with an upper (not shown). An upper may be depicted as having a substantially conventional configuration incorporating a plurality of material elements (e.g., textiles, foam, leather, and synthetic leather) that are stitched or adhesively bonded together to form an interior void for securely and comfortably receiving a foot. The material elements may be selected and located with respect to the upper in order to selectively impart properties of durability, air-permeability, wear-resistance, flexibility, and comfort, for example. In some embodiments, an ankle opening in the heel region provides access to the interior void. In some embodiments, the upper may include a lace that is utilized in a conventional manner to modify the dimensions of the interior void, thereby securing the foot within the interior void and facilitating entry and removal of the foot from the interior void. The lace may extend through apertures in the upper, and a tongue portion of the upper may extend between the interior void and the lace. Given that various aspects of the present discussion primarily relate to the sole structure 100, the upper may exhibit the general configuration discussed above or the general configuration of practically any other conventional or non-conventional upper. Accordingly, the overall structure of the upper may vary significantly.

For consistency and convenience, directional adjectives are employed throughout this detailed description corresponding to the illustrated embodiments. The term "longitudinal" as used throughout this detailed description and in the claims refers to a direction extending a length of a component, such as a sole structure. In some cases, the longitudinal direction may extend from a forefoot portion to a heel portion of the component. Also, the term "lateral" as used throughout this detailed description and in the claims refers to a direction extending a width of a component. In other words, the lateral direction may extend between a medial side and a lateral side of the component, or along the width of the component. The terms longitudinal and lateral can be used with any component of an article of footwear, including a sole structure as well as individual components of the sole structure.

In some embodiments, sole structure 100 may be secured to the upper and has a configuration that extends between the upper and the ground. In addition to attenuating ground reaction forces (i.e., cushioning the foot), the sole structure 100 may provide traction, impart stability, and limit various foot motions, such as pronation.

Some embodiments may include provisions for providing structural support to the sole structure 100. In some cases, rigid components may be associated with the sole structure 100. In some embodiments, the rigid components may be associated with the entire length of the sole structure 100. However, in other embodiments, the rigid components may be associated with only a portion of the sole structure 100. In some embodiments, the sole structure 100 may include one rigid component, while other embodiments may include more than one rigid component. Rigid components may provide the wearer with support in order to accelerate, provide stability, and may limit various unwanted foot motions.

Some embodiments may include provisions for providing flexibility to the sole structure 100. In some cases, flexible components may be associated with the sole structure 100. In some embodiments, the flexible components may be associated with the entire length of the sole structure 100. However, in other embodiments, the flexible components may be associated with only a portion of the sole structure 100. In some embodiments, the sole structure may include one flexible component, while other embodiments may include more than one flexible component. Flexible components allow the foot to bend and twist in order to allow the wearer to quickly maneuver, to change directions or to more accurately position the wearer's foot in a desired position.

Some embodiments may include provisions for allowing flexibility in some regions of the sole structure 100, while also allowing rigidity in other regions. In some cases, the flexible components may extend the entire length of the sole structure 100. However, in other cases the flexible components may extend over only portions of the sole structure 100. Similarly, in some cases, the rigid components may extend the entire length of the sole structure 110. However, in other cases the rigid components may extend over only portions of the sole structure 100. In some embodiments, rigid components may extend only into the heel and midsole region of the sole structure 100, while flexible components extend over the entire length of the sole structure 100, including the forefoot region. However, other embodiments may include flexible components extending over only the heel and midsole region, while the rigid components extend over the entire length of the sole structure 100. In some embodiments, the length of each component is adjusted in order to achieve the desired rigidity or flexibility in each region of the sole structure 100.

Some embodiments may include provisions for minimizing the overall weight of the sole structure 100. In some embodiments, porous or chambered components may be associated with the sole structure 100 in order to reduce the overall mass and weight. In some embodiments, the porous or chambered components may form a layer in the sole structure 100. However, in other embodiments, the porous or chambered components may be located in indentations or cavities in one or more of the other components in the sole structure 100. In some embodiments, the overall weight of the sole structure 100 is reduced when a porous or chambered member displaces all or a portion of a heavier component.

Some embodiments may include provisions for adjusting the thickness of each component throughout the length of the sole structure 100. In some embodiments, the rigid components may have increased thickness in regions of the sole structure 100 where more structural support is desired. In some embodiments, the rigid components may have decreased thickness in regions of the sole structure 100 where less structural support is desired. In some embodiments, the flexible components may have increased thickness in regions where more flexibility is desired, and may have decreased thickness in regions where less flexibility is desired. In some embodiments, porous or chambered components may have varying thickness throughout the length of the sole structure 100.

Referring to FIG. 1, some embodiments of the sole structure 100 may include an upper member 110, a chambered member 120, an intermediate member 130, a bottom member 140 and a plurality of cleat tips 150. In some embodiments, cleat tips 150 may include a first cleat tip 151, a second cleat tip 152, a third cleat tip 153, a fourth cleat tip 154, a fifth cleat tip 155 and a sixth cleat tip 156.

In one embodiment, sole structure 100 may include an upper member 110. In one embodiment, upper member 110 may be formed from a generally rigid material. FIG. 1 illustrates an upper member 110 having a top surface 119, a bottom surface 121, a forefoot region 111, a midfoot region 124, and a heel region 112. It will be understood that forefoot portion 111, midfoot portion 112 and heel portion 114 are only intended for purposes of description and are not intended to demarcate precise regions of sole structure 100. In some embodiments, the upper member 110 is oriented so that the top surface 119 of upper member 110 is facing the wearer's foot. Upper member 110 may serve to add durability to sole structure 100 and to form a separation barrier between the remaining components and the wearer's foot.

In some embodiments, upper member 110, intermediate member 130 and bottom member 140 may have one or more protruding portions. The protruding portions may include a depression or indentation that is concave relative to the top surface of the component, while extending out in a convex manner from the bottom surface of the component. Therefore, the term "protruding portion" as used throughout the specification and claims refers to the concave depression or indentation on the top surface of the component, as well as the corresponding convex surface on the bottom surface of the component. Referring to FIG. 1, for example, protruding portion 135 forms a depression or indentation that is concave relative to the top surface 161 of intermediate member 130, while also forming a convex surface 166 on the bottom surface 162 of intermediate member 30.

In some embodiments, upper member 110 may include a plurality of protruding portions associated with the top surface 119 and bottom surface 121. In some embodiments, the protruding portions include a depression on the top surface 119 of upper member 110, and extend out in a convex manner from the bottom surface 121 of upper member 110.

In some embodiments, the protruding portions may be associated with a cleat member. The term "cleat member" as used in this detailed description and throughout the claims includes any provisions disposed on a sole for increasing traction through friction or penetration of a ground surface. Typically, cleat members may be configured for any type of activity that requires traction.

Referring to FIG. 1, upper member 110 may include a first protruding portion 113 and second protruding portion 114 located in the heel region 112. FIG. 1 also shows a third protruding portion 115, fourth protruding portion 116, fifth protruding portion 117 and sixth protruding portion 118 in the forefoot region 111. In some embodiments, the sixth protruding portion 118 may include a depression in the top surface 119 of upper member 110, and extends down in a convex manner from the bottom surface 121 of upper member 110. In some embodiments, first protruding portion 113, second protruding portion 114, third protruding portion, 115, fourth protruding portion 116, and fifth protruding portion 117 are similarly shaped.

In some embodiments, the number of protruding portions in upper member 110 may vary. Although the upper member 110 illustrated in FIG. 1 includes a total of six protruding portions, other embodiments may include more or less than six protruding portions. For example, in some embodiments, upper member 110 may include a total of five or less protruding portions. In still further embodiments, upper member 110 may include a total of seven or more protruding portions. In some cases, the number of protruding portions substantially corresponds with the number of cleat members.

In some embodiments, the geometry of the protruding portions may vary. In some embodiments, the protruding portions may be rounded or dome-like in shape. In other embodiments, the protruding portions may be square or rectangular in shape. In other embodiments, the protruding portions may be triangular in shape. Additionally, it will be understood that the protruding portions may be formed in a wide variety of shapes, including but not limited to: hexagonal, cylindrical, conical, conical frustum, circular, square, rectangular, rectangular frustum, trapezoidal, diamond, ovoid, as well as any other shape known to those in the art.

Although not shown in the embodiment in FIG. 1, other embodiments may include an indentation along at least a portion of the center of upper member 110. In some embodiments, the indentation along the center of upper member 110 may be convex with respect to the top surface 119 of upper member 110. The indentation in the center of upper member 110 may increase the durability of the sole structure 100 and improve its resistance to shock.

In some embodiments, sole structure 100 may include a chambered member 120. The chambered member 120 may serve to strengthen the sole structure 100 while at the same time decreasing the overall weight. For example, in some embodiments, the chambered member 120 is made from a different material, and/or different mixture of materials, than the other components in the sole structure 100. However, in other embodiments, chambered member 120 is made from the same material as the other components, and/or recycled material used to make up other components. Decreasing the weight of sole structure 100 allows the wearer to move more quickly and efficiently, therefore enhancing the wearer's performance.

Although the chambered member 120 illustrated in FIG. 1 is generally Y-shaped, the overall shape of the chambered member 120 may vary in other embodiments. For example, in some embodiments, the chambered member 120 may form an oval, a rectangle, or any other shape in order to reduce the overall weight of the sole structure 100.

In some embodiments, the chambered member 120 may include a plurality of internal chambers. In other words, the volume of the chambered member 120 may include a plurality of cavities that are partitioned off from one another. In one embodiment, as illustrated in FIG. 1, the volume of the chambered member 120 may include a plurality of hexagon-shaped columns forming a honeycomb pattern. In other embodiments, the volume of the chambered member 120 may include a plurality of any geometrically-shaped columns. In some embodiments, chambered member 120 may include ribs, ridges or a variety of protuberances on the outer surface of chambered member 120. In other embodiments, chambered member 120 may be solid and/or include ribs or ridges formed on its outer surface.

In some embodiments, the top surface 122 of chambered member 120 faces the bottom surface 121 of upper member 110. In some embodiments, the bottom surface 123 of chambered member 120 corresponds to an indentation 131 in an intermediate member 130, which is discussed in further detail below.

In some embodiments, sole structure 100 may include an intermediate member 130. As illustrated in FIG. 1, intermediate member 130 may include a top surface 161, a bottom surface 162, a heel region 163, a midfoot region 164, and a forefoot region 165.

In some embodiments, intermediate member 130 may include an indentation 131. In some embodiments, indentation 131 may be concave in relation to the top surface 161 of intermediate member 130. This allows chambered member 120 to be received within indentation 131 as discussed above. In some embodiments, indentation 131 may be formed so that the top surface 122 of chambered member 120 is flush or level with the top surface 161 of intermediate member 130. However, in other embodiments, the top surface 122 of chambered member 120 may not be level with the top surface 161 of intermediate member 130.

In some embodiments, the shape of indentation 131 may vary. In some embodiments, indentation 131 may be Y-shaped in order to accommodate the shape of the chambered member 120. However, in other embodiments, indentation 131 may be any other shape that accommodates the chambered member 120.

In some embodiments, the location of indentation 131 may vary. In some embodiments, indentation 131 may be located in only a portion of intermediate member 130. For example, in one embodiment, as shown in FIG. 1, indentation 131 may be located mainly in the midfoot region 164 of intermediate member 130. However, in other embodiments, indentation 131 may be located in other regions of intermediate member 130. In some embodiments, indention 131 may be located in the forefoot region 165 of intermediate member 130. In another embodiment, indentation 131 may be located in the heel region 163 of intermediate member 130. In other embodiments, indentation 131 may be located in the forefoot region 165 and midfoot region 164. In still further embodiments, indentation 131 may be located in the midfoot region 164 and heel region 163. In still further embodiments, indentation 131 may run the entire length of the shoe and be located in the forefoot region 165, midfoot region 164 and heel region 163.

In some embodiments, upper member 110 may include a plurality of protruding portions associated with the top surface 161 and bottom surface 162 of intermediate member 130. In some embodiments, the protruding portions include a depression on the top surface of the component, and extend out in a convex manner from the bottom surface of the component. In some embodiments, the protruding portions may be associated with a cleat member.

Referring to FIG. 1, intermediate member 130 may include a first protruding portion 133 and a second protruding portion 134 located in the heel region 163. In some embodiments, intermediate member 130 may include a third protruding portion 135 and a fourth protruding portion 136 located in the forefoot region 165. As illustrated in FIG. 1, the fourth protruding portion 136 may include a depression that extends in a concave manner in relation to the top surface 161 of intermediate member 130, and extends down in a convex manner from the bottom surface 162 of intermediate member 130. In some embodiments, first protruding portion 133, second protruding portion 134, and third protruding portion 135 may be similarly shaped.

In some embodiments, the geometry of the protruding portions in intermediate member 130 may vary. In some embodiments, the protruding portions may be rounded or dome-like in shape. In other embodiments, the protruding portions may be square or rectangular in shape. In other embodiments, the protruding portions may be triangular in shape. Additionally, it will be understood that the protruding portions may be formed in a wide variety of shapes, including but not limited to: hexagonal, cylindrical, conical, conical frustum, circular, square, rectangular, rectangular frustum, trapezoidal, diamond, ovoid, as well as any other shape known to those in the art.

In some embodiments, the number of protruding portions in intermediate member 130 may vary. Although the intermediate member 130 illustrated in FIG. 1 includes a total of four protruding portions, other embodiments may include more or less than four protruding portions. For example, in some embodiments, intermediate member 130 may include a total of three or less protruding portions. In still further embodiments, intermediate member 130 may include a total of five or more protruding portions.

In some embodiments, sole structure 100 may include a bottom member 140. As illustrated in FIG. 1, bottom member 140 may include a top surface 171, a bottom surface 172, a heel region 147, a midfoot region 148, and a forefoot region 149. In some embodiments, the bottom member 140 may form the outer layer of the bottom surface of the sole structure 100.

In some embodiments, bottom member 140 may include a plurality of protruding portions associated with the top surface 171 and bottom surface 172 of bottom member 140. In some embodiments, the protruding portions include a depression on the top surface of the component, and extend out in a convex manner from the bottom surface of the component. In some embodiments, the protruding portions may be associated with a cleat member.

Referring to FIG. 1, bottom member 140 may include a first protruding portion 143 and a second protruding portion 144 located in the heel region 147. In some embodiments, bottom member 140 may include a third protruding portion 145, a fourth protruding portion 146, a fifth protruding portion 141 and a sixth protruding portion 142 located in the forefoot region 149. As illustrated in FIG. 1, the sixth protruding portion 142 may include a depression in the top surface 171 of bottom member 140, and extends out in a convex manner from the bottom surface 172 of bottom member 140. In some embodiments, first protruding portion 143, second protruding portion 144, third protruding portion 145, fourth protruding portion 146, and fifth protruding portion 141 may be similarly shaped.

In some embodiments, the number of protruding portions in bottom member 140 may vary. Although the bottom member 140 illustrated in FIG. 1 includes a total of six protruding portions, other embodiments may include more or less than six protruding portions. For example, in some embodiments, bottom member 140 may include a total of five or less protruding portions. In still further embodiments, bottom member 140 may include a total of seven or more protruding portions.

In some embodiments, the geometry of the protruding portions in bottom member 140 may vary. In some embodiments, the protruding portions may be rounded or dome-like in shape. In other embodiments, the protruding portions may be square or rectangular in shape. In other embodiments, the protruding portions may be triangular in shape. Additionally, it will be understood that the protruding portions may be formed in a wide variety of shapes, including but not limited to: hexagonal, cylindrical, conical, conical frustum, circular, square, rectangular, rectangular frustum, trapezoidal, diamond, ovoid, as well as any other shape known to those in the art. In some embodiments, the protruding portion can have an elongated and/or rectangular shape that is configured to correspond to the shape of cleat tips 150.

In some embodiments, cleat tips 150 may be associated with one or more protruding portions in the bottom surface 172 of bottom member 140. In some embodiments, first cleat tip 153 may be fixedly attached to the bottom surface 172 associated with the first protruding portion 143 in bottom member 140. In a similar manner, second cleat tip 154, third cleat tip 155, fourth cleat tip 156, fifth cleat tip 151 and sixth cleat tip 152 may be associated with second protruding portion 144, third protruding portion 145, fourth protruding portion 146, fifth protruding portion 141 and sixth protruding portion 142 respectively.

In some embodiments, the components shown in FIG. 1 may be joined together to form a sole structure 100. In some embodiments, the bottom surface 123 of chambered member 120 may be placed in, and attached to, indentation 131 located in the top surface 161 of intermediate member 130. In some embodiments, the bottom surface 121 of upper member 110 may be attached to the top surface 161 of intermediate member 130. In some embodiments, the top surface 122 of chambered member 120 may also be attached to the bottom surface 121 of upper member 110. In some embodiments, the bottom surface 162 of intermediate member 130 may be attached to the top surface 171 of bottom member 140.

In some embodiments, the protruding portions in each component may be aligned or mated with one another when forming sole structure 100. In some embodiments, first protruding portion 113 in upper member 110, first protruding portion 133 in intermediate member 130, and first protruding portion 143 in bottom member 140 may be mated when forming sole structure 100. In particular, the convex portion of first protruding portion 113 in upper member 110 may fit into the depression of first protruding portion 133 in intermediate member 130. Likewise, the convex portion of first protruding portion 133 in intermediate member 130 may fit into the depression of first protruding portion 143 in bottom member 140. In a similar manner, each of the protruding portions of upper member 110, intermediate member 130 and bottom member 140 may be joined with corresponding protruding portions on adjacent members. For example, in some embodiments, second protruding portion 114 in upper member 110, second protruding portion 134 in intermediate member 130, and second protruding portion 144 in bottom member 140 may be mated when forming sole structure 100. Also, in some embodiments, third protruding portion 115 in upper member 110, third protruding portion 135 in intermediate member 130, and third protruding portion 145 in bottom member 140 may be mated when forming sole structure 100. In some embodiments, fourth protruding portion 116 in upper member 110, fourth protruding portion 136 in intermediate member 130, and fourth protruding portion 146 in bottom member 140 may be mated when forming sole structure 100. In embodiments where intermediate member 130 does not extend over the full length of sole structure 100, fifth protruding portion 117 and sixth protruding portion 118 in upper member 110 may be directly mated with fifth protruding portion 141 and sixth protruding portion 142 in bottom member 140, respectively.

A sole structure 100 may include provisions for evenly dissipating the forces incurred in the area proximate to each cleat member. Generally, the cleat members are the first component to strike the ground and therefore receive a substantial amount of stress. In order to absorb this stress, some embodiments may include a rigid layer of material that extends into the cleat members as well as a substantial portion of the sole structure 100. This allows the forces exerted on the cleat members to be evenly distributed over a large surface area of the rigid layer, thereby increasing the overall strength of the sole structure 100.

Figure 2:
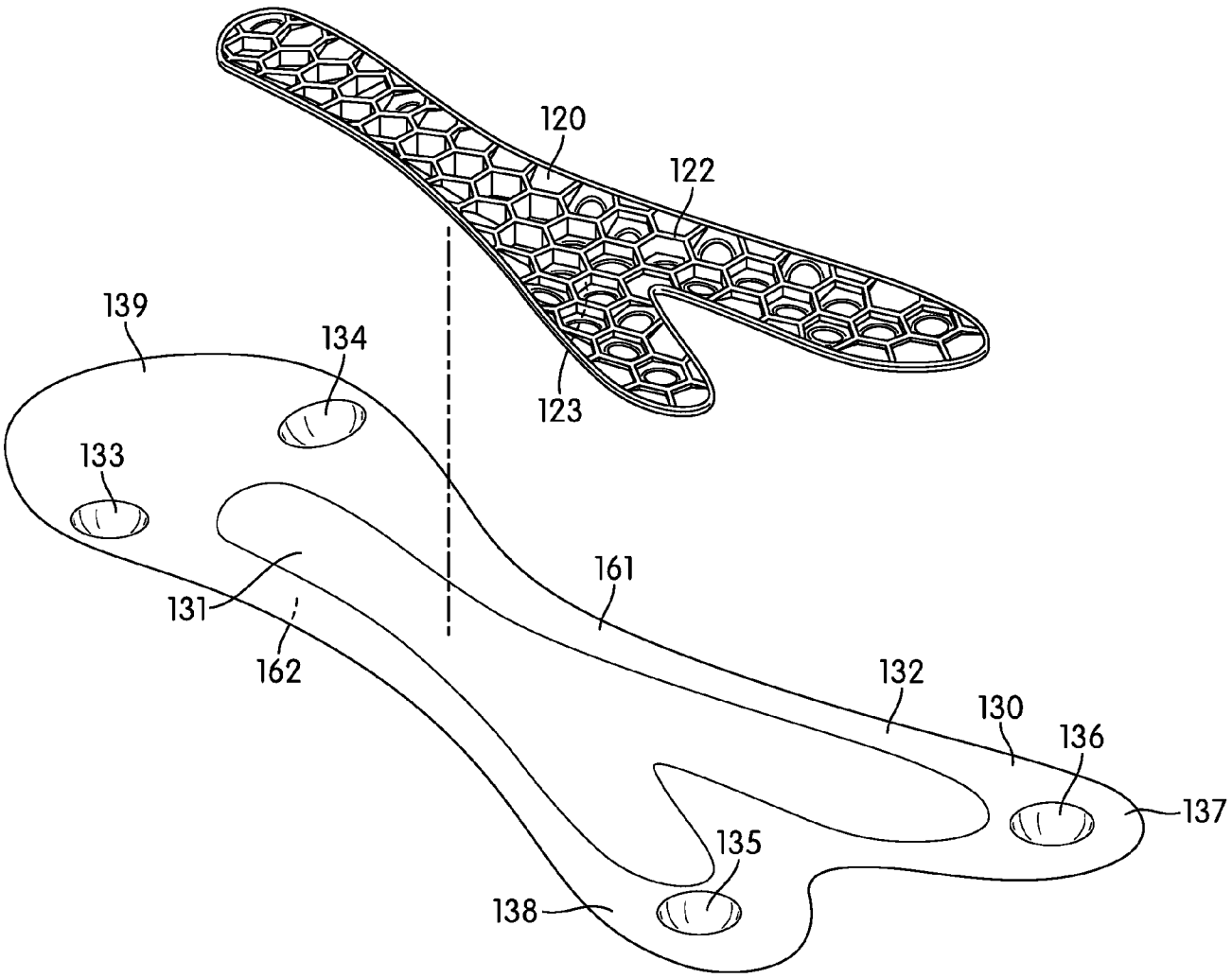
FIG. 2 is an isometric view of one embodiment of a Y-shaped honeycomb structure located in an indentation.

In some embodiments, rigidity of the sole structure 100 may be increased by including a chambered member 120 and an intermediate member 130. FIG. 2 more clearly shows the relationship between the chambered member 120 and the intermediate member 130. Indentation 131, located in the top surface 161 of intermediate member 130 may be formed into a shape that will accommodate the volume of chambered member 120. In some embodiments, the surface forming indentation 131 may support the bottom surface 123 of chambered member 120.

The shape of intermediate member 130 may vary. In some embodiments, as shown in FIG. 2, intermediate member 130 may include one or more projections. In one embodiment, intermediate member 130 may include one or more rounded projections, or lobes. In another embodiment, intermediate member 130 may include one or more rectangular or square-shaped projections. In still further embodiments, intermediate member 130 may include one or more triangular-shaped projections. In still further embodiments, intermediate member 130 may include any number of other geometrical or non-geometrical shaped projections.

In some embodiments, intermediate member 130 includes a first projection 137, a second projection 138 and a third projection 139. In some embodiments, first projection 137 and second projection 138 may be separated by a gap, while the third projection 139 extends rearwardly. For example, intermediate member 130 may be generally Y-shaped. In other embodiments, intermediate member 130 may be V-shaped, or W-shaped.

Referring to FIG. 2, intermediate member 130 may include a number of protruding portions associated with cleat members. In some embodiments, first projection 137 may include fourth protruding portion 136, while second projection 138 may include third protruding portion 135. Similarly, third projection 139 may include first protruding portion 133 and second protruding portion 134. The presence of first protruding portion 133, second protruding portion 134, third protruding portion 135 and fourth protruding portion 136 in intermediate member 130 provide for localized stiffening and enable the sole structure 100 to moderate, and more evenly distribute, pressure placed on the cleat members.

In different embodiments, the material composition of one or more components of sole structure 100 can vary. In some cases, for example, upper member 110, chambered member 120, intermediate member 130 and bottom member 140 may be made of a variety of different materials that provide for a lightweight and rigid, yet flexible, sole structure 100. Some embodiments may also use one or more components, features, systems and/or methods discussed in Auger et al., U.S. Patent Publication Number 2008/0010863, published on Jan. 17, 2008, which is hereby incorporated by reference in its entirety.

Upper member 110 may be formed from a variety of materials. Generally, the materials used with upper member 110 can be selected to achieve a desired rigidity, flexibility, or desired characteristic for upper member 110. In some embodiments, upper member 110 may be formed from a weave and/or mesh of glass fibers, fiberglass, fiberglass composite and/or glass-reinforced plastic. In some embodiments, the weave or mesh may be anodized or coated with one or more alloy(s) or metal(s), like silver. In some embodiments, upper member 110 may be formed from carbon, carbon fiber, carbon composite, and/or recycled or reground carbon materials. In some embodiments, upper member 110 may be formed from thermoplastic polyurethanes, recycled thermoplastic polyurethane, and/or composite including thermoplastic polyurethane. In some embodiments, the upper member 110 may be formed from the same material as the upper member 110. Any combination of materials known to those in the art may form the upper member 110. In some embodiments, upper member 110 may include one or more regions or portions made from different materials. In some embodiments, upper member 110 may include fibers made from a plurality of materials. For example, in some embodiments, upper member 110 may be made from a variety of composite materials. In some embodiments, upper member 110 may include both carbon and glass fibers. In some embodiments, upper member 110 may include fibers made from a mixture of carbon and one or more other materials. In some embodiments, upper member 110 may include materials made from a mixture of glass and one or more other materials. In other embodiments, upper member 110 may be made from materials that do not include glass fibers or carbon fibers. However, in one embodiment, upper member 110 may be made of fiberglass and/or fiberglass composite.

In some embodiments, upper member 110 may be made of layers that have varying orientations with respect to one another. In some embodiments, upper member 110 may include fibers that are oriented in an alternating 0/90° orientation and/or an alternating 45°/45° orientation. In some embodiments, upper member 110 may include layers having fibers that are oriented laterally. In some embodiments, upper member 110 may include layers having fibers that are oriented longitudinally. In some embodiments, upper member may include layers having fibers that are oriented side-by-side one another. In other embodiments, upper member 110 may include layers having fibers that are oriented diagonally, or at some angle, with respect to a lateral or longitudinal axis. In some embodiments, each layer in upper member 110 may include one or more portions having fibers that are oriented longitudinally, laterally, side-by-side, and/or diagonally. In some embodiments, each layer of upper member 110 may include one or more portions or regions having different orientations. For example, in one embodiment upper member 110 may include a layer that is diagonally oriented in the forefoot region and longitudinally oriented in the heel region. Other variations in regional orientation are possible. Other embodiments discussed herein in this specification and claims may also include these features of the upper member 110.

The chambered member 120 may be formed from a variety of materials. Generally, the materials used with chambered member 120 can be selected to achieve a desired rigidity, flexibility, or desired characteristic for chambered member 120. In some embodiments, chambered member 120 may be formed from a weave and/or mesh of glass fibers, fiberglass, fiberglass composite and/or glass-reinforced plastic. In some embodiments, the weave or mesh may be anodized or coated with one or more alloy(s) or metal(s), like silver. In some embodiments, chambered member 120 may be formed from carbon, carbon fiber, carbon composite, and/or recycled or reground carbon materials. In some embodiments, chambered member 120 may be formed from thermoplastic polyurethanes, recycled thermoplastic polyurethane, and/or composite including thermoplastic polyurethane. Any combination of materials known to those in the art may form the chambered member 120. In some embodiments, chambered member 120 may include one or more regions or portions made from different materials. In some embodiments, chambered member 120 may include fibers made from a plurality of materials. For example, in some embodiments, chambered member 120 may be made from a variety of composite materials. In some embodiments, chambered member 120 may include both carbon and glass fibers. In some embodiments, chambered member 120 may include fibers made from a mixture of carbon and one or more other materials. In some embodiments, chambered member 120 may include materials made from a mixture of glass and one or more other materials. In other embodiments, chambered member 120 may be made from materials that do not include glass fibers or carbon fibers. However, in one embodiment, chambered member 120 may be made of a carbon and/or carbon composite.

In some embodiments, chambered member 120 may be made of layers that have varying orientations with respect to one another. In some embodiments, chambered member 120 may include fibers that are oriented in an alternating 0/90° orientation and/or an alternating 45°/45° orientation. In some embodiments, chambered member 120 may include layers having fibers that are oriented laterally. In some embodiments, chambered member 120 may include layers having fibers that are oriented longitudinally. In some embodiments, chambered member 120 may include layers having fibers that are oriented side-by-side one another. In other embodiments, chambered member 120 may include layers having fibers that are oriented diagonally, or at some angle, with respect to a lateral or longitudinal axis. In some embodiments, each layer in chambered member 120 may include one or more portions having fibers that are oriented longitudinally, laterally, side-by-side, and/or diagonally. In some embodiments, each layer of chambered member 120 may include one or more portions or regions having different orientations. For example, in one embodiment chambered member 120 may include a layer that is diagonally oriented in the midfoot region and longitudinally oriented in the heel region. Other variations in regional orientation are possible. Other embodiments discussed herein in this specification and claims may also include these features of the chambered member 120.

The intermediate member 130 may be formed from a variety of materials. Generally, the materials used with intermediate member 130 can be selected to achieve a desired rigidity, flexibility, or desired characteristic for intermediate member 130. In some embodiments, intermediate member 130 may be formed from a weave and/or mesh of glass fibers, fiberglass, fiberglass composite and/or glass-reinforced plastic. In some embodiments, the weave or mesh may be anodized or coated with one or more alloy(s) or metal(s), like silver. In some embodiments, intermediate member 130 may be formed from carbon, carbon fiber, carbon composite, and/or recycled or reground carbon materials. In some embodiments, intermediate member 130 may be formed from thermoplastic polyurethanes, recycled thermoplastic polyurethane, and/or composite including thermoplastic polyurethane. In some embodiments, the intermediate member 130 may be formed from the same material as the intermediate member 130. Any combination of materials known to those in the art may form the intermediate member 130. In some embodiments, intermediate member 130 may include one or more regions or portions made from different materials. In some embodiments, intermediate member 130 may include fibers made from a plurality of materials. For example, in some embodiments, intermediate member 130 may be made from a variety of composite materials. In some embodiments, intermediate member 130 may include both carbon and glass fibers. In some embodiments, intermediate member 130 may include fibers made from a mixture of carbon and one or more other materials. In some embodiments, intermediate member 130 may include materials made from a mixture of glass and one or more other materials. In other embodiments, intermediate member 130 may be made from materials that do not include glass fibers or carbon fibers. However, in one embodiment, intermediate member 130 may be made from carbon fiber.

In some embodiments, intermediate member 130 may be made of layers that have varying orientations with respect to one another. In some embodiments, intermediate member 130 may include fibers that are oriented in an alternating 0/90° orientation and/or an alternating 45°/45° orientation. In some embodiments, intermediate member 130 may include layers having fibers that are oriented laterally. In some embodiments, intermediate member 130 may include layers having fibers that are oriented longitudinally. In some embodiments, intermediate member 130 may include layers having fibers that are oriented side-by-side one another. In other embodiments, intermediate member 130 may include layers having fibers that are oriented diagonally, or at some angle, with respect to a lateral or longitudinal axis. In some embodiments, each layer in intermediate member 130 may include one or more portions having fibers that are oriented longitudinally, laterally, side-by-side, and/or diagonally. In some embodiments, each layer of intermediate member 130 may include one or more portions or regions having different orientations. For example, in one embodiment intermediate member 130 may include a layer that is diagonally oriented in the forefoot region and longitudinally oriented in the heel region. Other variations in regional orientation are possible.

Other embodiments discussed herein in this specification and claims may also include these features of the intermediate member 130.

The bottom member 140 may be made from a variety of materials. In some embodiments, bottom member 140 may be formed from a plastic. In another embodiment, any combination of materials known to those in the art may be used to form bottom member 140. For example, in some embodiments, bottom member 140 may be made from a mixture of the same materials that are used to make upper member 110, intermediate member 130, and/or chambered member 120.

The upper member 110, chambered member 120, intermediate member 130, and/or bottom member 140 may be formed in any manner. In some embodiments, each component is molded into a preformed shape. In some embodiments, the edges of each component are trimmed using any means known to those in the art, including a water jet.

The cleat tips 150 may be formed from a variety of materials. Generally, the materials used with cleat tips 150 can be selected to achieve a desired rigidity, flexibility, or desired characteristic for cleat tips 150. In some embodiments, cleat tips 150 may be formed from a weave and/or mesh of glass fibers, fiberglass, fiberglass composite and/or glass-reinforced plastic. In some embodiments, the weave or mesh may be anodized or coated with one or more alloy(s) or metal(s), like silver. In some embodiments, cleat tips 150 may be formed from carbon, carbon fiber, carbon composite, and/or recycled or reground carbon materials. In some embodiments, cleat tips 150 may be formed from thermoplastic polyurethanes, recycled thermoplastic polyurethane, and/or composite including thermoplastic polyurethane. In some embodiments, the cleat tips 150 are formed from the same material as the chambered member 120. Any combination of materials known to those in the art may form the cleat tips 150. In some embodiments, cleat tips 150 may include one or more regions or portions made from different materials. In some embodiments, cleat tips 150 may include fibers made from a plurality of materials. For example, in some embodiments, cleat tips 150 may be made from a variety of composite materials. In some embodiments, cleat tips 150 may include both carbon and glass fibers. In some embodiments, cleat tips 150 may include fibers made from a mixture of carbon and one or more other materials. In some embodiments, cleat tips 150 may include materials made from a mixture of glass and one or more other materials. In other embodiments, cleat tips 150 may be made from materials that do not include glass fibers or carbon fibers. However, in one embodiment cleat tips 150 are made of a carbon and/or carbon composite.

In some embodiments, cleat tips 150 may be made of layers that have varying orientations with respect to one another. In some embodiments, cleat tips 150 may include fibers that are oriented in an alternating 0/90° orientation and/or an alternating 45°/45° orientation. In some embodiments, cleat tips 150 may include layers having fibers that are oriented laterally. In some embodiments, cleat tips 150 may include layers having fibers that are oriented longitudinally. In some embodiments, cleat tips 150 may include layers having fibers that are oriented side-by-side one another. In other embodiments, cleat tips 150 may include layers having fibers that are oriented diagonally, or at some angle, with respect to a lateral or longitudinal axis. In some embodiments, each layer in cleat tips 150 may include one or more portions having fibers that are oriented longitudinally, laterally, side-by-side, and/or diagonally. In some embodiments, each layer of cleat tips 150 may include one or more portions or regions having different orientations. For example, in one embodiment cleats tips 150 may include a layer that is diagonally oriented in the forefoot region and longitudinally oriented in the heel region. Other variations in regional orientation are possible. Other embodiments discussed herein in this specification and claims may also include these features of the cleat tips 150.

The components shown in FIGS. 1 and 2 may be bonded or attached to one another using a variety of methods. In some embodiments, heat pressure may be applied to the components in order bond them together. In some embodiments, thermoplastic polyurethane may be used to bond the components to one another. In another embodiment, any form of adhesive may be used to bond the components together. In still further embodiments, other methods of bonding the components known to those in the art may be used. In some embodiments, upper member 110 and intermediate member 130 are placed in a mold and chambered member 120 is injected into the indentation 131.

Figure 3:
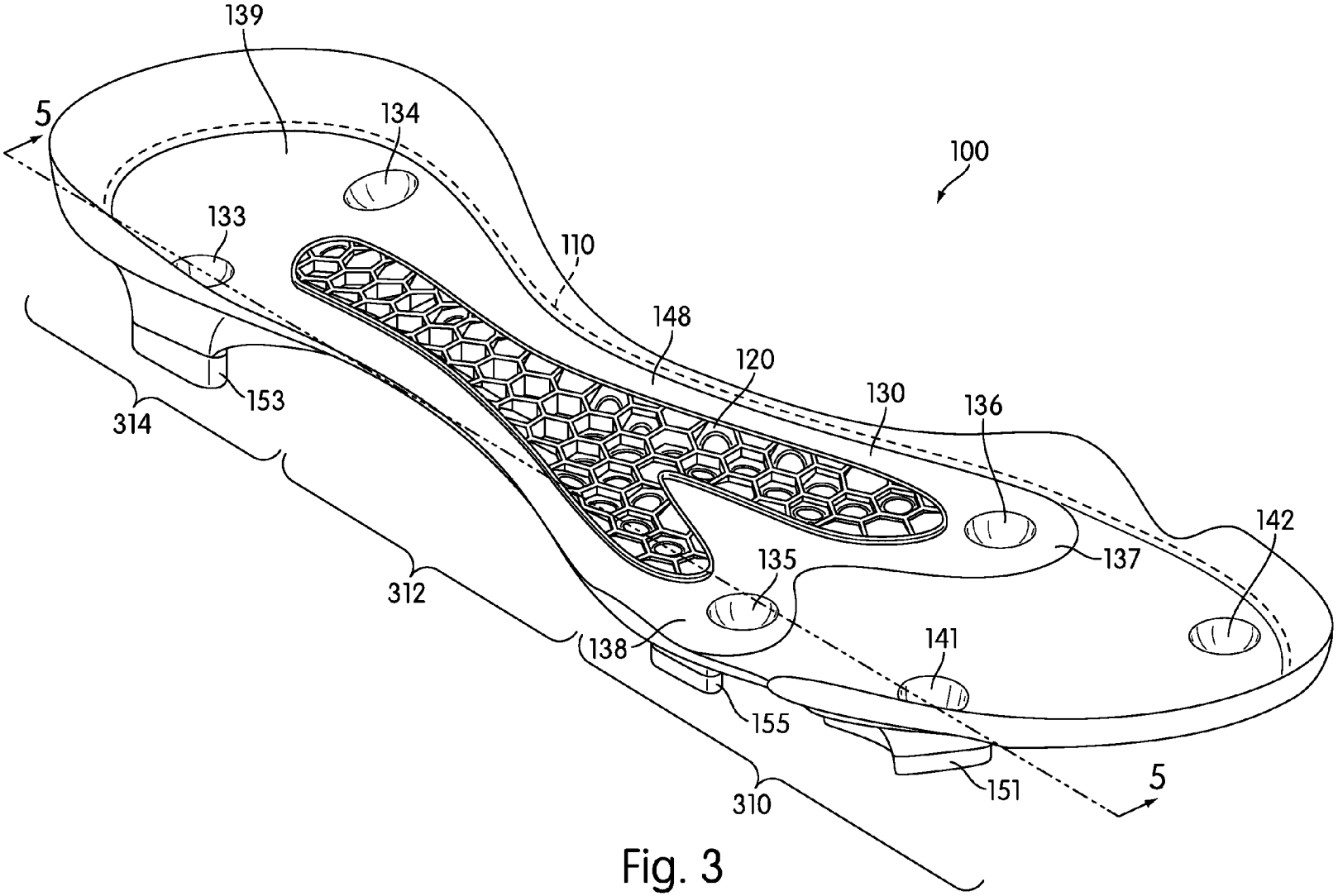
FIG. 3 is a partial view of one embodiment of a sole structure.

FIG. 3 illustrates the components shown in FIG. 1 after they have been assembled. In other words, the upper member 110, chambered member 120, intermediate member 130 are placed on the bottom member 140, and the cleat tips 150 have been attached. Upper member 110 is transparent in FIG. 3 in order to facilitate an understanding of the components underneath. The sole structure 100 shown in FIG. 3 may include a forefoot region 310, a midfoot region 312, and a heel region 314.

Referring to FIG. 3, the location of the projections of intermediate member 130 in relation to other components of the sole structure 100 may vary. In some embodiments, intermediate member 130 may include a first projection 137, a second projection 138 and a third projection 139. In some embodiments, at least a portion of the first projection 137 and at least a portion of the second projection 138 may be located in a portion of the forefoot region 310, while at least a portion of the third projection 139 may be located in at least a portion of the midfoot region 312. In some embodiments, at least a portion of the first projection 137 and at least a portion of the second projection 138 may be located in at least a portion of the midfoot region 312, while at least a portion of the third projection 139 may be located in at least a portion of the heel region 314. In some embodiments, at least a portion of the first projection 137 and at least a portion of the second projection 138 may be located in at least a portion of the forefoot region 310, while at least a portion of the third projection 139 is located in at least a portion of the heel region 314.

In some embodiments, the length of intermediate member 130 may vary. In some embodiments, intermediate member 130 may extend from at least a portion of the heel region 314 to at least a portion of the midfoot region 312. In other embodiments, intermediate member 130 may extend from at least a portion of the midfoot region 312 to at least a portion of the forefoot region 310. In other embodiments, intermediate member 130 may extend from at least a portion of the heel region 314, through the midfoot region 312, and into at least a portion of the forefoot region 310. Varying the length of the intermediate member 130 so that it extends over at least a portion of the bottom member 140 may reduce the overall weight of sole structure 100.

Figure 4:
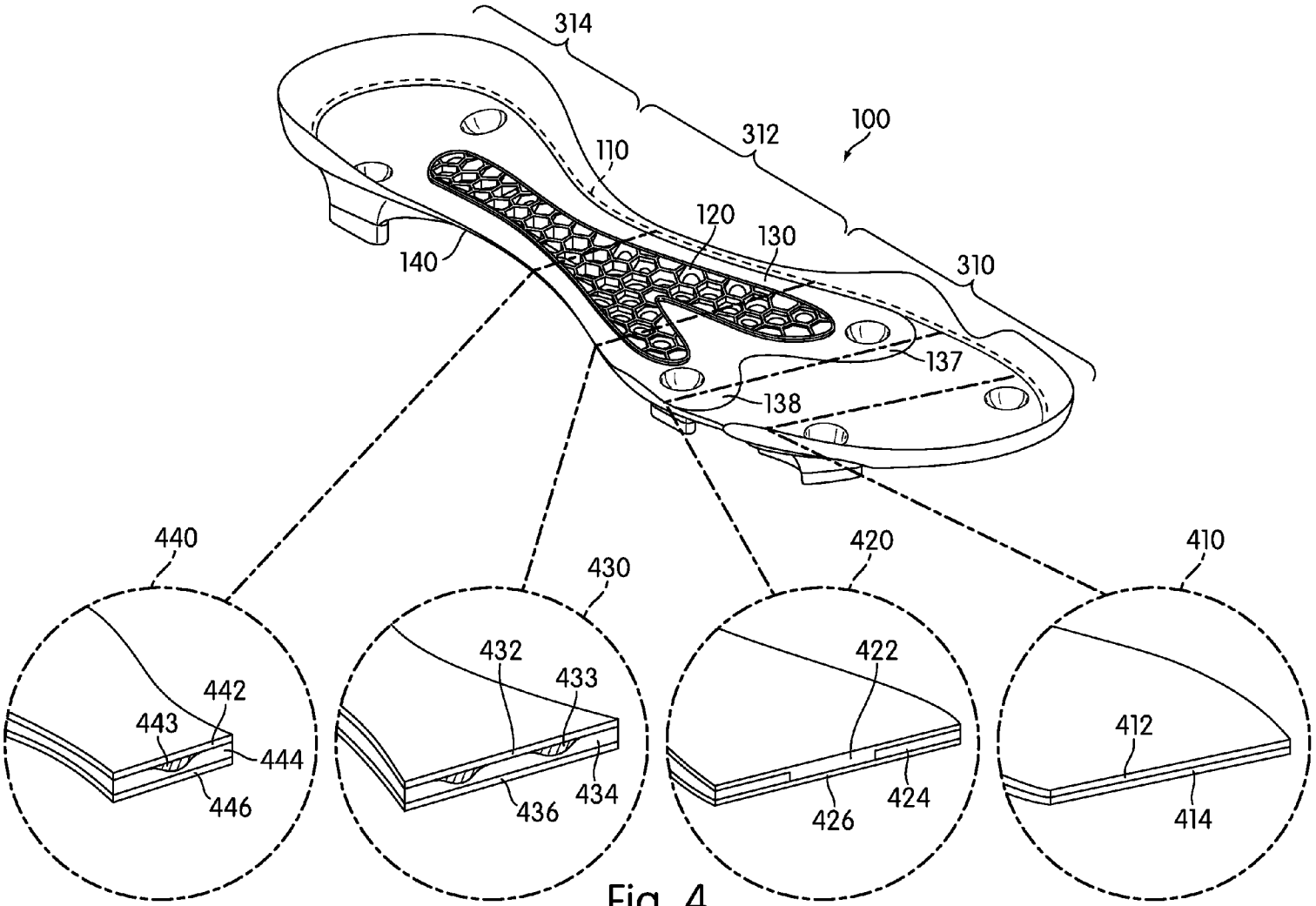
FIG. 4 is a perspective view of one embodiment of a sole structure illustrating several cross-sectional views at different points along a longitudinal length of the sole structure.

FIG. 4 illustrates cross-sectional views at various points along the longitudinal length of the sole structure 100 shown in FIGS. 1-3. The sole structure 100 shown in FIG. 4 includes all the components shown in FIG. 1 after they have been assembled. Upper member 110 is transparent in order to facilitate an understanding of the components underneath.

FIG. 4 includes two cross-sectional views in the forefoot region 310, and two cross-sectional views in the midfoot region 312.

Referring to FIG. 4, a first cross-sectional view 410 in the forefoot region shows only two layers: a portion 412 of upper member 110 and a portion 414 of bottom member 140. Although first cross-sectional view 410 shows a portion 412 of upper member 110 and a portion 414 of bottom member 140 having approximately the same thickness in this region, the actual thicknesses may vary relative to one another. In some embodiments, a portion 412 of upper member 110 may be made from glass composite and a portion 414 of bottom member 140 may be made from plastic. In such an embodiment, the region shown in cross-sectional view 410 may provide a significant amount of flexibility. In other embodiments, a portion 412 of upper member 110 and a portion 414 of bottom member 140 may be made from any other type of materials.

A second cross-sectional view 420 shown in FIG. 4 may be located in the forefoot region 310 but more towards the heel region 314 than the first cross-sectional view 410. In one embodiment, as shown in the second cross-sectional view 420, a portion 424 of intermediate member 130 is located between a portion 422 of upper member 110 and a portion 426 of bottom member 140. In some embodiments, a portion 422 of upper member 110 may be made from glass composite, a portion 424 of intermediate member 130 may be made from carbon composite, and a portion 426 of bottom member 140 may be made from plastic. In such an embodiment, the region shown in cross-sectional view 420 may provide rigidity from the carbon composite portion 424 of intermediate member 130, in addition to flexibility from the glass composite portion 422 of upper member 110. In other embodiments, portion 422 of upper member 110, portion 424 of intermediate member 130, and portion 426 of bottom member 140 may be made from any other type of materials. It should be noted that the thicknesses of portion 422 of upper member 110, portion 424 of intermediate member 130, and portion 426 of bottom member 140 may vary in relation to one another.

A third cross-sectional view 430 shown in FIG. 4 may be located in the midfoot region 312. In one embodiment, as shown in third cross-sectional view 430, portion 434 of intermediate member 130 may be located between portion 432 of upper member 110 and portion 436 of bottom member 140. In one embodiment, as shown in third cross-sectional view 430, portion 433 of chambered member 120 may be located between portion 432 of upper member 110 and portion 434 of intermediate member 130. In some embodiments, chambered portion 433 of chambered member 120 may have a Y-shape. In some embodiments, portion 432 of upper member 110 may be made from glass composite, portion 434 of intermediate member 130 may be made from carbon composite, and portion 436 of bottom member 140 may be made from plastic. In such an embodiment, portion 432 of upper member 110 may provide flexibility in this region, while portion 434 of intermediate member 130 and portion 433 of chambered member 120 may provide rigidity in this region. In some embodiments, portion 433 of chambered member 120 may have a honeycomb volume and may be made from carbon or carbon composite. In such an embodiment, chambered portion 433 of member 120 may provide rigidity to this region, while at the same time reducing the overall weight of the sole structure 100. In other embodiments, portion 432 of upper member 110, portion 433 of chambered member 120, portion 434 of intermediate member 130, and portion 436 of bottom member 140 may be made from any other type of materials. It should be noted that in some embodiments, the thicknesses of portion 432 of upper member 110, portion 433 of chambered member 120, portion 434 of intermediate member 130, and portion 436 of bottom member 140, may vary in relation to one another.

A fourth cross-sectional view 440 shown in FIG. 4 is located in the midfoot region 312 but more towards the heel region 314 than the third cross-sectional view 430. In one embodiment, as shown in fourth cross-sectional view 440, portion 444 of intermediate member 130 may be located between portion 442 of upper member 110 and portion 446 of bottom member 140. In some embodiments, portion 443 of chambered member 120 may be located between portion 442 of upper member 110 and portion 444 of intermediate member 130. In one embodiment, chambered member 120 may have a Y-shape. As can be seen in fourth cross-sectional view 440, portion 443 may form the stem of the Y-shaped chambered member 120. Portion 443 of chambered member 120 may be located between portion 442 of upper member 110 and portion 444 of intermediate member 130. In some embodiments, portion 442 of upper member 110 may be made from glass composite, portion 444 of intermediate member 130 may be made from carbon composite, and portion 446 of bottom member 140 may be made from plastic. In such an embodiment, portion 442 of upper member 110 may provide flexibility in this region, while portion 444 of intermediate member 130 and portion 443 of chambered member 120 may provide rigidity in this region. In some embodiments, portion 443 of chambered member 120 may have a honeycomb volume and may be made from carbon or carbon composite. In such an embodiment, portion 443 of chambered member 120 may provide rigidity to this region, while at the same time reducing the overall weight of the sole structure 100. In other embodiments, portion 442 of upper member 110, portion 443 of chambered member 120, portion 444 of intermediate member 130, and portion 446 of bottom member 140 may be made from any other type of materials. It should be noted that the thicknesses of portion 442 of upper member 110, portion 443 of chambered member 120, portion 444 of intermediate member 130, and portion 446 of bottom member 140, as shown in fourth cross-sectional view 440, may vary in relation to one another.

In some embodiments, provisions may be included for providing different zones of flexibility along the longitudinal length of the sole structure 100. Different zones of flexibility can be created by varying the material, thickness, and/or longitudinal length of the components making up the sole structure 100. In some embodiments, the zones of flexibility can be adjusted in order to adapt to the shape of each wearer's foot. In some embodiments, the zones of flexibility can be adjusted in order to adapt to each wearer's running style. In some embodiments, the zones of flexibility can be adjusted in order to adapt to the type of sport and/or activity in which the wearer will be involved.

Figure 5:
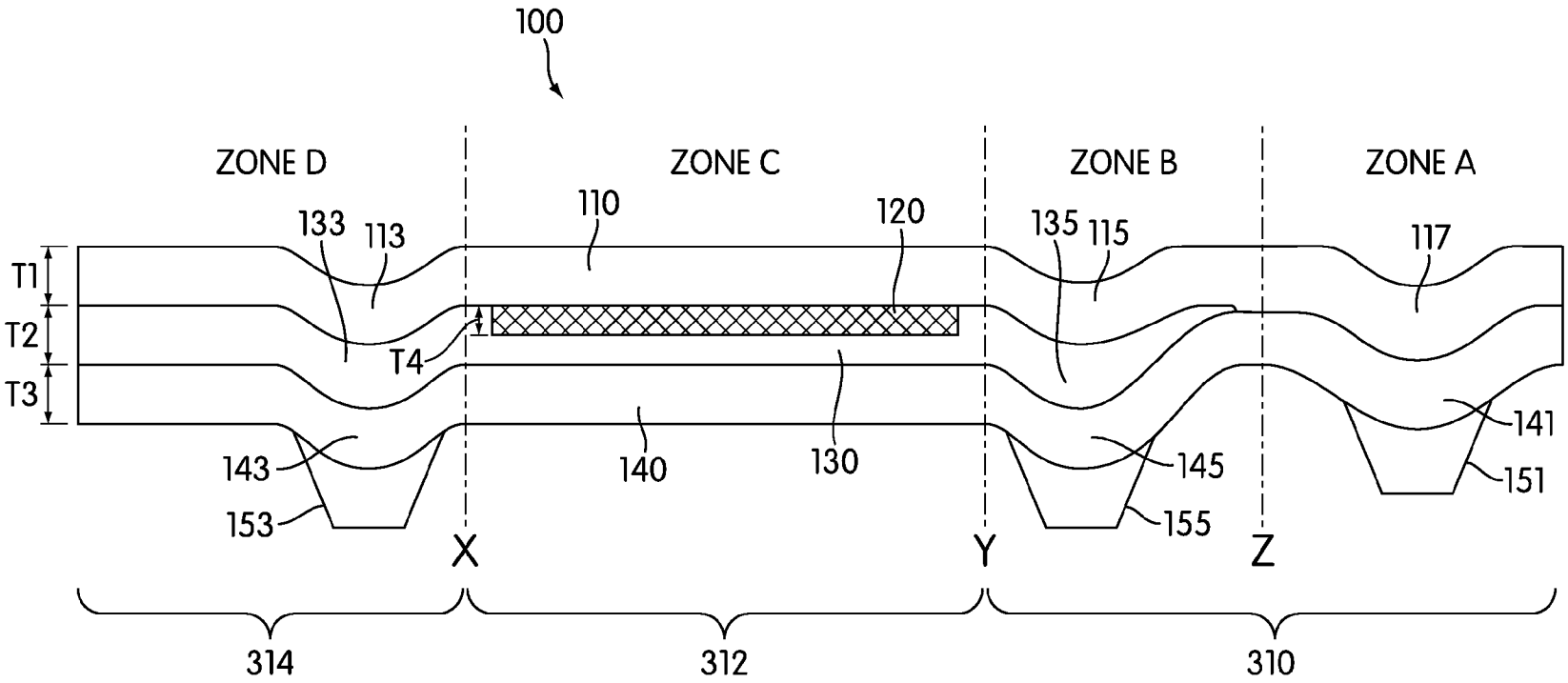
FIG. 5 is a cross-sectional view of along the longitudinal length of one embodiment of a sole structure showing the varying zones of flexibility.

FIG. 5 illustrates a schematic cross-section of the embodiment of the sole structure 100 taken along line 5-5 in FIG. 3. FIG. 5 describes one embodiment relating to different zones of flexibility along the longitudinal length of the sole structure 100 shown in FIGS. 1-4. FIG. 5 shows four zones of flexibility along the longitudinal length of the shoe. In some embodiments, zone D may be associated with a heel region 314 of the sole structure 100. In some embodiments, zone C may be associated with a midsole region 312 of the sole structure 100. In some embodiments, zone A and B may be associated with a forefoot region 310 of the sole structure 100. In other embodiments, the zones of flexibility may or may not be associated with the heel region, midsole region, and/or forefoot region of the sole structure 100. Although FIG. 5 shows four zones, other embodiments may include more or less than four zones of flexibility. In other embodiments, upper member 110, intermediate member 130 and bottom member 140 may be made from any other type of materials.

Referring to FIG. 5, the four zones are generally separated by boundary X, boundary Y and boundary Z. In particular, boundary X may generally separate zone D and zone C. Likewise, boundary Y may generally separate zone C and zone B. Furthermore, boundary Z may generally separate zone B and zone A.

In some embodiments, the zones of flexibility may be controlled in part by the longitudinal length of each component and/or the material making up each component. In the embodiment shown in FIG. 5, upper member 110 may extend from zone D to zone A. In some embodiments, upper member 110 may be made from a glass composite. The glass composite upper member 110 may provide for flexibility throughout the longitudinal length of the sole structure 100 from zone D to zone A. For example, upper member 110 may provide for flexibility to the cleat member associated with first protruding portion 113 in heel region 314. As a further example, upper member 110 may provide for flexibility in the midfoot region 312. As a further example, upper member 110 may provide for flexibility to the cleat members associated with third protruding portion 115 and fifth protruding portion 117 in the forefoot region 310.

Also shown in FIG. 5 is a chambered member 120 extending through zone C. In some embodiments, the chambered member 120 may be made from carbon or carbon composite. The carbon composite chambered member 120 may provide rigidity, or stiffness, in the midfoot region 312 of sole structure 100. In some embodiments, the volume of chambered member 120 forms a honeycomb, which may reduce the overall weight of sole structure 100 while at the same time providing rigidity, or stiffness.

Also shown in FIG. 5 is an intermediate member 130 extending from zone D to zone B. In some embodiments, the intermediate member 130 may be made from carbon or carbon composite. The carbon composite intermediate member 130 may provide for additional rigidity, or stiffness, from the heel region 314 into a portion of the forefoot region 310. For example, carbon composite intermediate member 130 may provide for rigidity in the cleat member associated with first protruding portion 133 in the heel region 314. As a further example, carbon composite intermediate member 130 may provide for rigidity in the midfoot region 312. As a further example, carbon composite intermediate member 130 may provide for rigidity in the cleat member associated with third protruding portion 135 in zone B. The carbon composite intermediate member 130 is capable of absorbing impact pressure felt in the cleat members associated with first protruding portion 133 and third protruding portion 135. Since the carbon composite intermediate member 130 does not extend past boundary Z into the zone A, the sole structure 100 in FIG. 5 may be more flexible in zone A than in zone B. Since the carbon composite intermediate member 130 is not located in the more flexible zone A, carbon composite intermediate member 130 is less likely to become denatured due to excessive bending and flexing that may occur in zone A.

Also shown in FIG. 5 is a bottom member 140 extending from zone D to zone A. In some embodiments, the bottom member 140 may be made from plastic. In other embodiments, the bottom member 140 may be made from any material known to those in the art would understand to make up an article of footwear.

Some embodiments may include provisions for varying the material composition of each component along the longitudinal length of the sole structure 100 in order to achieve the desired flexibility and/or rigidity in each zone. For example, in some embodiments, upper member 110 may have a different material composition in one zone than in the remaining zones. In other embodiments, upper member 110 may have a different material composition in two or more zones than in the remaining zone(s). In some embodiments, intermediate member 130 may have a different material composition in one zone than in the remaining zones. In other embodiments, intermediate member 130 may have a different material composition in two or more zones than in the remaining zone(s). In some embodiments, bottom member 140 may have a different material composition in one zone than in the remaining zones. In some embodiments, bottom member 140 may have a different material composition in two or more zones than the remaining zone(s). In some embodiments, each component may have a varying composition within the same zone of flexibility.

The thickness of each component in sole structure 100 may vary. As shown in FIG. 5, upper member 110 may have a thickness T1, intermediate member 130 may have a thickness T2, bottom member 140 may have a thickness T3, and chambered member 120 may have thickness T4. In some embodiments, thickness T1, thickness T2 and thickness T3 may be equal. In other embodiments, thickness T1 may be equal to thickness T2, while thickness T2 is less than or greater than thickness T3. In other embodiments, thickness T1 may be equal to thickness T3, while thickness T3 is less than or greater than thickness T2. In other embodiments, thickness T2 may be equal to thickness T3, while thickness T3 is less than or greater than thickness T1. In other embodiments, thickness T1, thickness T2 and thickness T3 may all have different values.

A sole structure 100 may include provisions for adjusting the flexibility and/or rigidity of the sole structure 100 by varying the thickness of each component in throughout each zone of flexibility. In some embodiments, each component may have a different thickness in each zone of flexibility. In some embodiments, each component may have the same thickness throughout one or more zones of flexibility. In other embodiments, the thickness of each component may vary in specific zones of flexibility in order to increase or decrease the rigidity and/or flexibility in that particular zone. For example, in some embodiments where intermediate member 130 is made from carbon composite and a more flexible zone B is desired, thickness T2 of intermediate member 130 may decrease in zone B to be less than the thickness in zone C and/or D. As a further example, in embodiments where intermediate member 130 is made from carbon composite and a more rigid zone B is desired, thickness T2 of intermediate member 130 may increase in zone B to be more than the thickness in zone C and/or zone D. In other embodiments, the thickness T2 of intermediate member 130 may vary throughout the longitudinal length of the sole structure 100 in order to achieve the desired flexibility and/or rigidity in each zone of flexibility.

In some embodiments, the thickness T1 of upper member 110 may vary throughout the longitudinal length of the sole structure 100 in order to achieve the desired flexibility and/or rigidity in each zone of flexibility. For example, in some embodiments where the upper member 110 is made from glass composite and a more flexible zone B is desired, thickness T1 of upper member 110 may be increased in zone B to be more than the thickness in zone C and/or D. As a further example, in some embodiments, where the upper member 110 is made from glass composite and a less flexible zone B is desired, thickness T1 of upper member 110 is decreased in zone B to be less than the thickness in zone C and/or D.

In some embodiments, the thickness T3 of bottom member 140 may vary throughout the longitudinal length of the sole structure 100 in order to achieve the desired flexibility and/or rigidity in each zone of flexibility. In some embodiments, the thickness T4 of chambered member 120 may vary throughout the longitudinal length of the sole structure 100 in order to achieve the desired flexibility and/or rigidity.

Figure 6:
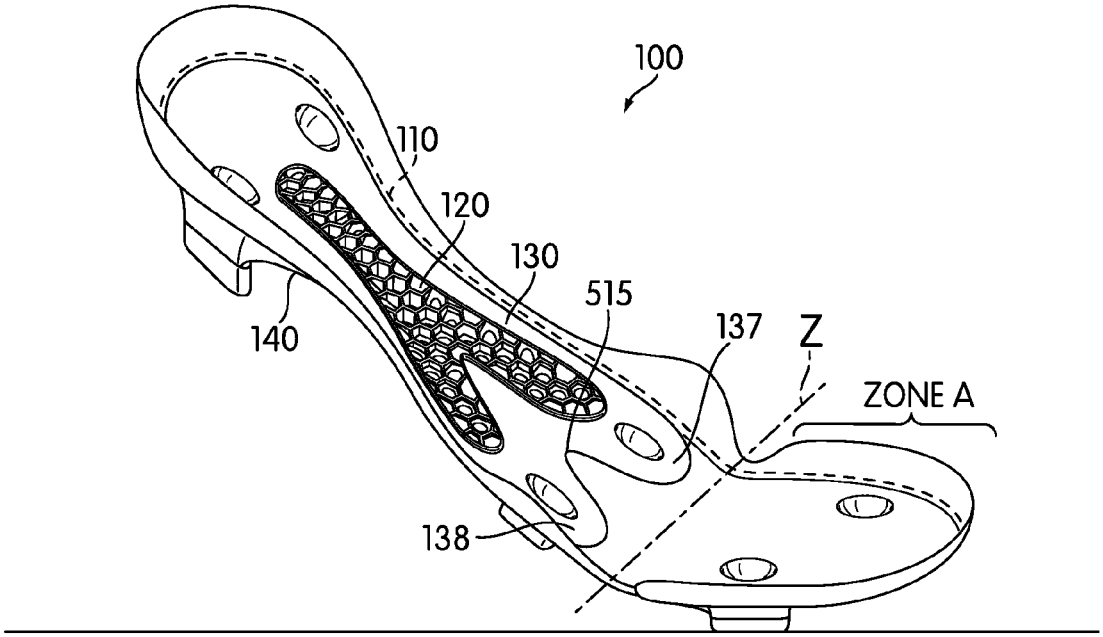
FIG. 6 is a perspective view of one embodiment of a sole structure while in use.

FIG. 6 shows the sole structure 100 in FIGS. 1-5 while the wearer is running on ground 510. As illustrated in FIG. 6, the sole structure 100 may flex or bend at boundary Z, or anywhere in zone A. The flexibility along boundary Z, as well as in zone A, allows the toes of the wearer to bend as needed during use.

In some embodiments, provisions can be made to prevent denaturing of the intermediate member 130. Denaturing of the intermediate member 130 may occur if the intermediate member 130 is exposed to excessive bending or other forces. In some embodiments, the shape of intermediate member 130 may prevent the denaturing of the material making up intermediate member 130. As can be seen in FIG. 6, only a small portion of first projection 137 and second projection 138 are located on boundary Z, or zone A. In contrast, a curved portion 515 is located some distance away from boundary Z as well as zone A. The shape of intermediate member 130 acts to prevent denaturing of the material making up intermediate member 130, because curved portion 515 is not exposed to the bending forces present along boundary Z or in zone A. Although the embodiment in FIG. 6 shows a curved portion 515, other shapes are also possible. In some embodiments, intermediate member 130 may form a triangular or rectangular portion instead of a curved portion 515. In other embodiments, intermediate member 130 may form any other shape instead of curved portion 515.

Figure 7:
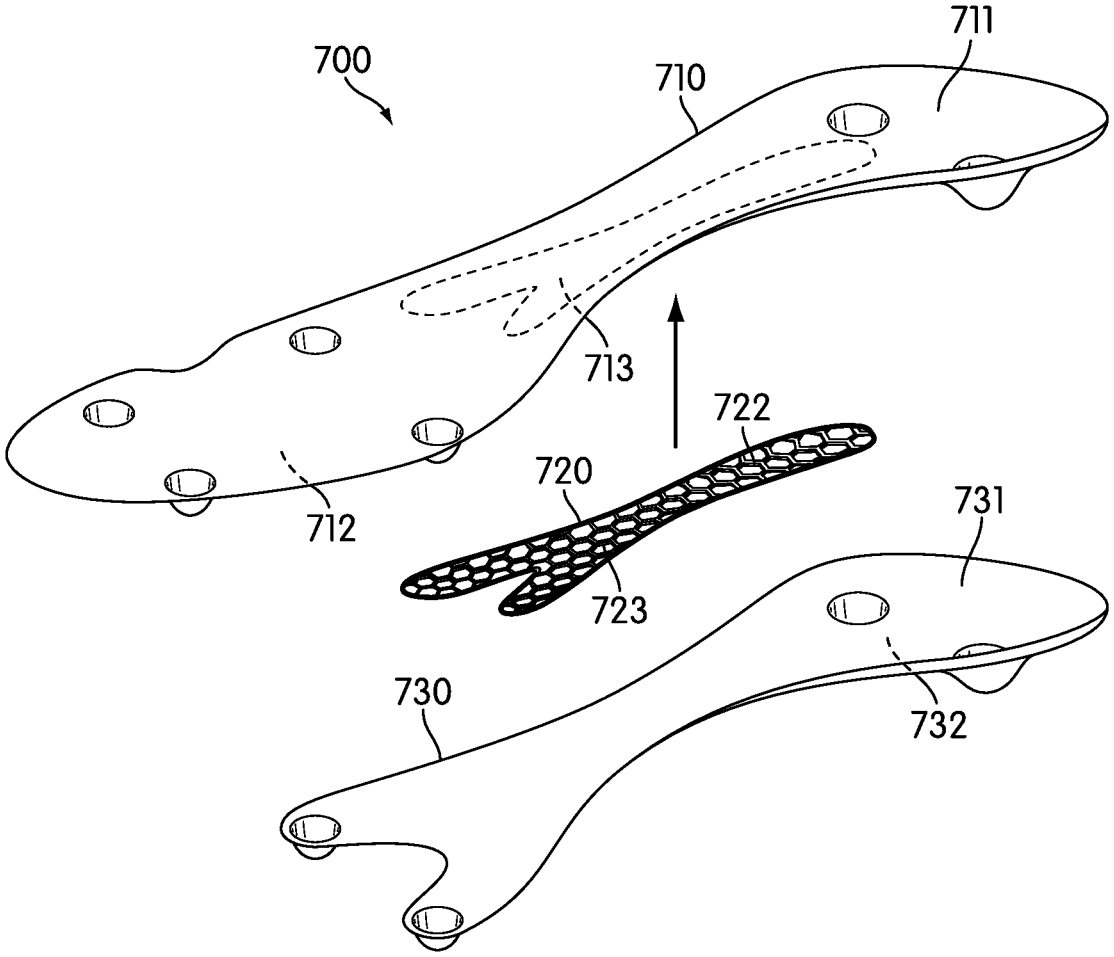
FIG. 7 is an exploded isometric view of another embodiment of a sole structure having an indentation in the upper member.

In some embodiments, the organization of the components may vary in order to adjust a sole structure 100 to the proper stiffness and/or rigidity. FIG. 7, for example, illustrates one embodiment of a sole structure 700 which may provide more rigidity than the embodiment shown in FIGS. 1-6. The embodiment shown in FIG. 7 includes an upper member 710, a chambered member 720, and an intermediate member 730. The embodiment shown in FIG. 7 is similar to the embodiments discussed in FIGS. 1-6, except that the chambered member 720 is located within an indentation 713 in the bottom surface 712 of the upper member 710. Generally, locating the chambered member 720 inside an indentation 713 in the bottom surface 712 of upper member 710 increases the overall rigidity of the sole structure 700 in the region of the chambered member 720. In some embodiments, the chambered member 720 may be substantially flat and have a substantially constant thickness throughout. Although FIG. 7 shows the chambered member 720 positioned in an indentation 713 in the bottom surface 712 of upper member 710, the current embodiments are not so limited. For example, in some embodiments only a portion of chambered member 720 may be located within indentation 713 in upper member 710. In some embodiments, only a portion of chambered member 720 may be located within an indentation (not shown in FIG. 7) in the top surface 731 of intermediate member 730. In other embodiments, a portion of chambered member 720 may be located within indentation 713 in upper member 710, while another portion of chambered member 720 may be located in an indentation (not shown in FIG. 7) in the top surface 731 of intermediate member 730.

The properties and relationships among the various components described in FIGS. 1-6 may also apply to the embodiment shown in FIG. 7. For example, the embodiments described in FIG. 7 may also include a bottom member 140 and cleat tips 150 as discussed in FIGS. 1-6, even though these components are not described in FIG. 7. In some embodiments, upper member 710, chambered member 720 and intermediate member 730 may be made from the same materials, and methods, as previously discussed in FIGS. 1 and 2 for upper member 110, chambered member 120 and intermediate member 130, respectively.

The relationship among the components described in FIG. 7 may be similar to the relationships of the components described in FIGS. 1-6. In some embodiments, upper member 710 may have a top surface 711 and a bottom surface 712. In some embodiments, the bottom surface 712 of upper member 710 may have an indentation 713 for receiving the chambered member 720. As illustrated in FIG. 7, indentation 713 in the bottom surface 712 of upper member 710 may be adapted to receive the top surface 722 of chambered member 720. In some embodiments, the entire volume of the chambered member 720 may be located in the indentation 713, so that the bottom surface 723 of chambered member 720 is level with the bottom surface 712 of upper member 710. In some embodiments, the bottom surface 723 of chambered member 720, as well as the bottom surface 712 of upper member 710, may be attached to the top surface 731 of intermediate member 730.

The materials making up the components shown in FIG. 7 may vary in order to provide for rigidity in some areas, while providing for flexibility in other areas. In some embodiments, both upper member 710 and intermediate member 730 may be made from carbon or carbon composite. In some embodiments, both upper member 710 and intermediate member 730 may be made from glass or glass composite. In some embodiments, upper member 710 may be made from glass or glass composite and intermediate member 730 may be made from carbon or carbon composite. In other embodiments, upper member 710 may be made form carbon or carbon composite and intermediate member 730 may be made from glass or glass composite. The materials making up the upper member 710 and intermediate member 730 may be any of the materials previously discussed for upper member 110 and intermediate member 130, respectively, in FIGS. 1-6.

The structure and make up of the chambered member 720 may vary. In some embodiments, chambered member 720 may form a honeycomb volume. In some embodiments, carbon chambered member 720 having a honeycomb volume may form a lightweight yet rigid layer in sole structure 700. In some embodiments, chambered member 720 having a honeycomb volume may add enough rigidity such that the thickness of other components may be reduced. By reducing the thickness of other solid components, the weight of the overall sole structure 700 is reduced. In some embodiments, chambered member 720 may be made from any of the materials previously discussed for chambered member 120 in FIGS. 1-6.

Components from different embodiments may be combined with, or replace, components in other embodiments in order to adjust for the desired rigidity and/or flexibility of the sole structure. For example, in some embodiments, upper member 710 described in FIG. 7 may be used in place of upper member 110 described in FIGS. 1-6. In such an embodiment, bottom surface 123 of chambered member 120 would be positioned in indentation 131 in the top surface 161 of the intermediate member 130, while the top surface 122 of chambered member 120 would be positioned in indentation 713 on the bottom surface 712 of upper member 710.

Figure 8:
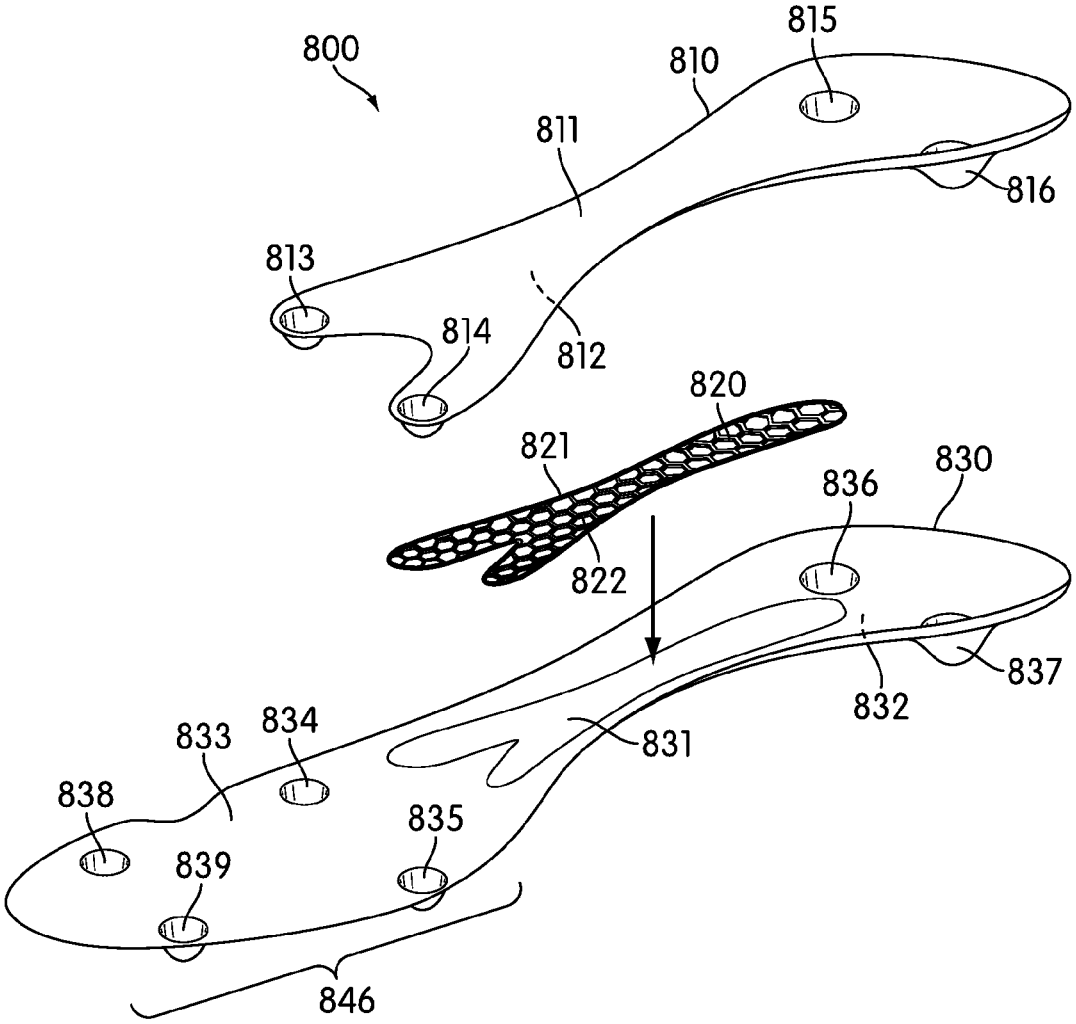
FIG. 8 is an exploded isometric view of another embodiment of a sole structure having an upper member that extends over only a portion of the intermediate member in the forefoot region.

In some embodiments, the organization of the components may further vary in order to adjust for the proper stiffness and/or rigidity. FIG. 8, for example, illustrates another embodiment of a sole structure 800. The embodiment shown in FIG. 8 is similar to the embodiments discussed in FIGS. 1-6, except that upper member 810 extends over only a portion of the intermediate member 830 in the forefoot area 840. Generally, orienting the components in such a manner may provide for increased rigidity closer to the wearer's foot.

The properties and relationships among the various components described in FIGS. 1-6 also apply to the embodiment shown in FIG. 8. For example, the embodiments described in FIG. 8 may also include a bottom member 140 and cleat tips 150 as discussed in FIGS. 1-6, even though these components are not described in FIG. 8. The embodiments described in FIG. 8 include an upper member 810, a chambered member 820, and an intermediate member 830. In some embodiments, upper member 810, chambered member 820 and intermediate member 830 may be made from the same materials, and methods, as previously discussed in FIGS. 1 and 2 for upper member 110, chambered member 120 and intermediate member 130, respectively.

The components in FIG. 8 may have similar relationships to one another as the components described in FIGS. 1-7. In some embodiments, intermediate member 830 may have a top surface 833 and a bottom surface 832. In some embodiments, the top surface 833 of intermediate member 830 may have an indentation 831 for receiving the chambered member 820. As illustrated in FIG. 8, indentation 831 in the top surface 833 of intermediate member 830 may be adapted to receive the bottom surface 822 of chambered member 820. In some embodiments, the entire volume of the chambered member 820 may be located in the indentation 831, so that the top surface 821 of chambered member 820 is level with the top surface 833 of intermediate member 830. In some embodiments, the top surface 821 of chambered member 820, as well as the top surface 823 of intermediate member 830, may be attached to the bottom surface 812 of upper member 810.

In some embodiments, the components shown in FIG. 8 may be assembled in a similar manner as the components described in FIGS. 1-6. As can be seen in FIG. 8, when bottom surface 812 of upper member 810 is attached to top surface 833 of intermediate member 830, upper member 810 only covers a portion of the intermediate member 830 in the forefoot region 846. In some embodiments, first protruding portion 815 in upper member 810 and first protruding portion 836 in intermediate member 830 may be mated when forming sole structure 800. Likewise, in some embodiments, second protruding portion 816 in upper member 810 and second protruding portion 837 in intermediate member 830 may be mated when forming sole structure 800. In some embodiments, third protruding portion 813 in upper member 810 and third protruding portion 834 in intermediate member 830 may be mated when forming sole structure 800. In some embodiments, fourth protruding portion 814 in upper member 810 and fourth protruding portion 835 in intermediate member 830 may be mated when forming sole structure 800. Note however, in contrast to the previous embodiments, fifth protruding portion 838 and sixth protruding portion 839 in intermediate member 830 may not be mated with any depressions in upper member 810.

The materials making up the components shown in FIG. 8 may vary in order to provide for rigidity in some areas, while providing for flexibility in other areas. In some embodiments, both upper member 810 and intermediate member 830 may be made from carbon or carbon composite. In some embodiments, both upper member 810 and intermediate member 830 may be made from glass or glass composite. In some embodiments, upper member 810 may be made from glass or glass composite and intermediate member 830 may be made from carbon or carbon composite. In other embodiments, upper member 810 may be made form carbon or carbon composite and intermediate member 830 may be made from glass or glass composite. The materials making up the upper member 810 and intermediate member 830 may be any of the materials previously discussed for upper member 110 and intermediate member 130, respectively, in FIGS. 1-6.

The structure and make up of the chambered member 820 may vary. In some embodiments, chambered member 820 may form a honeycomb volume. In some embodiments, carbon chambered member 820 having a honeycomb volume may form a lightweight yet rigid layer in sole structure 800. In some embodiments, chambered member 820 having a honeycomb volume may add enough rigidity such that the thickness of other components may be reduced. By reducing the thickness of other solid components, the weight of the overall sole structure 800 is reduced. In some embodiments, chambered member 820 may be made from any of the materials previously discussed for chambered member 120 in FIGS. 1-6.

In some embodiments, intermediate member 830 may be made from glass composite, chambered member 820 may be made from carbon or carbon composite, and upper member 810 may be made from carbon or carbon composite. In some embodiments, indentation 831 in top surface 833 of intermediate member 830, as well as chambered member 820, may be Y-shaped. In some embodiments, chambered member 820 may have a honeycomb volume. In such an embodiment, the rigidity of the sole structure 800 is increased in the area of the chambered member 820 since the flexible glass composite is being replaced by a rigid carbon or carbon composite. In addition, a more rigid carbon composite upper member 810 is located near the wearer's foot than the embodiments illustrated in FIGS. 1-6.

Figure 9:
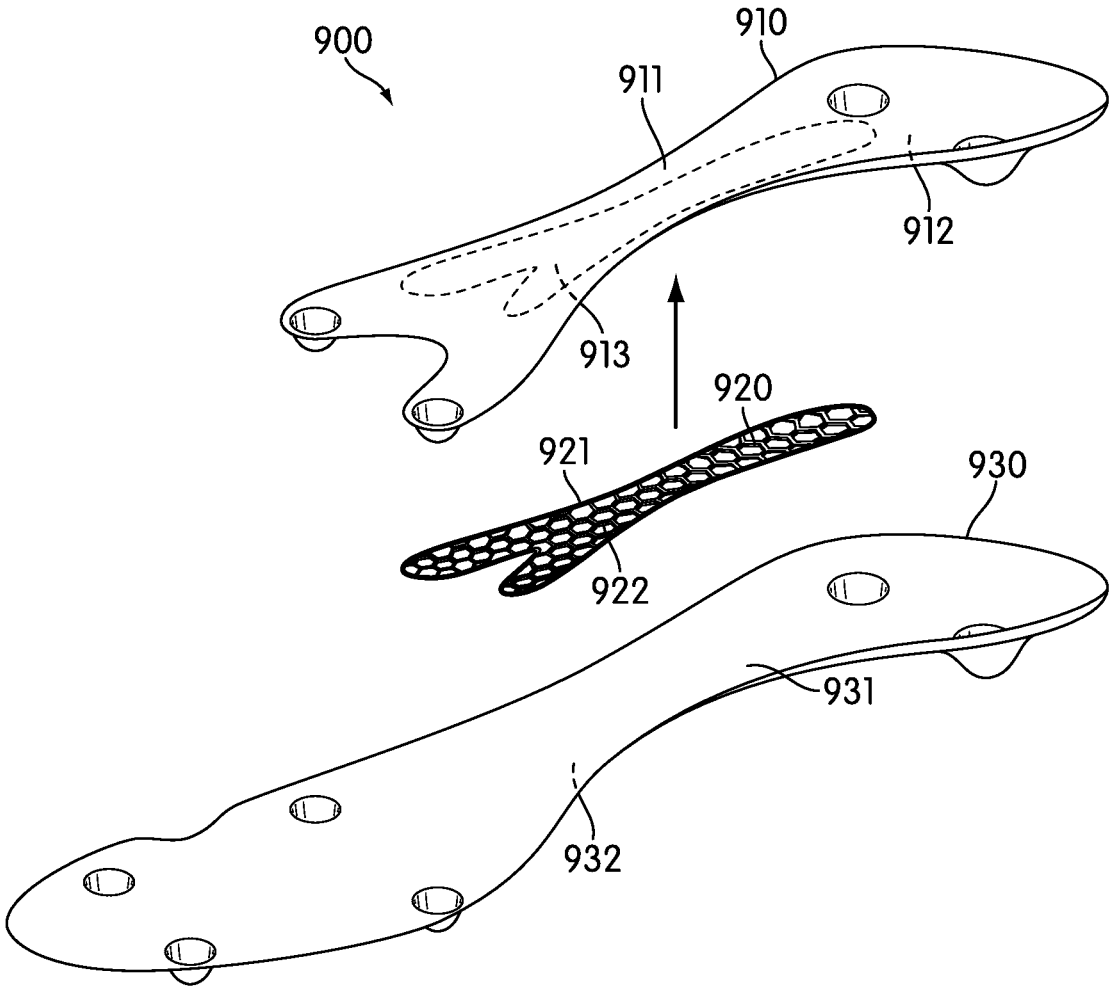
FIG. 9 is an exploded isometric view of another embodiment of a sole structure having an indentation in the upper member.

In some embodiments, the organization of the components may further vary in order to adjust a sole structure 900 to the proper stiffness and/or rigidity. FIG. 9, for example, illustrates another embodiment of a sole structure 900. The embodiment shown in FIG. 9 includes an upper member 910, a chambered member 920, and an intermediate member 930. The embodiment shown in FIG. 9 is similar to the embodiments discussed in FIG. 8, except that the chambered member 920 is located within an indentation 913 in the bottom surface 912 of the upper member 910. Generally, locating the chambered member 920 inside an indentation 913 in the bottom surface 912 of upper member 910 decreases the overall weight of the sole structure 900 compared to the sole structure 800 described in FIG. 8.

The properties and relationships among the various components described in FIGS. 1-6 also apply to the embodiment shown in FIG. 9. For example, the embodiments described in FIG. 9 may also include a bottom member 140 and cleat tips 150 as discussed in FIGS. 1-6, even though these components are not described in FIG. 9. The embodiments described in FIG. 9 include an upper member 910, a chambered member 920 and an intermediate member 930. In some embodiments, upper member 910, chambered member 920 and intermediate member 930 may be made from the same materials, and methods, as previously discussed in FIGS. 1-6 for upper member 110, chambered member 120 and intermediate member 130, respectively.

The components in FIG. 9 may have similar relationships to one another as the components described in FIGS. 1-6. In some embodiments, upper member 910 may have a top surface 911 and a bottom surface 912. In some embodiments, the bottom surface 912 of upper member 910 may have an indentation 913 for receiving the chambered member 920. As illustrated in FIG. 9, indentation 913 in the bottom surface 912 of upper member 910 may be adapted to receive the top surface 921 of chambered member 920. In some embodiments, the entire volume of the chambered member 920 may be located in the indentation 913, so that the bottom surface 922 of chambered member 920 is level with the bottom surface 912 of upper member 910. In some embodiments, the bottom surface 922 of chambered member 920, as well as the bottom surface 912 of upper member 910, may be attached to the top surface 931 of intermediate member 930. In some embodiments, the chambered member 920 may be substantially flat and have a substantially constant thickness throughout. Although FIG. 9 shows the chambered member 920 positioned in an indentation 913 in the bottom surface 912 of upper member 910, the current embodiments are not so limited. For example, in some embodiments only a portion of chambered member 920 may be located within indentation 913 in upper member 910. In some embodiments, only a portion of chambered member 920 may be located within an indentation (not shown in FIG. 9) in the top surface 931 of intermediate member 930. In other embodiments, a portion of chambered member 920 may be located within indentation 913 in upper member 910, while another portion of chambered member 920 may be located in an indentation (not shown in FIG. 9) in the top surface 931 of intermediate member 930.

The materials making up the components shown in FIG. 9 may vary in order to provide for rigidity in some areas, while providing for flexibility in other areas. In some embodiments, both upper member 910 and intermediate member 930 may be made from carbon or carbon composite. In some embodiments, both upper member 910 and intermediate member 930 may be made from glass or glass composite. In some embodiments, upper member 910 may be made from glass or glass composite and intermediate member 930 may be made from carbon or carbon composite. In other embodiments, upper member 910 may be made form carbon or carbon composite and intermediate member 930 may be made from glass or glass composite. The materials making up the upper member 910 and intermediate member 930 may be any of the materials previously discussed for upper member 110 and intermediate member 130, respectively, in FIGS. 1-6.

The structure and make up of the chambered member 920 may vary. In some embodiments, chambered member 920 may form a honeycomb volume. In some embodiments, carbon chambered member 920 having a honeycomb volume may form a lightweight yet rigid layer in sole structure 900. In some embodiments, chambered member 920 having a honeycomb volume may add enough rigidity such that the thickness of other components may be reduced. By reducing the thickness of other solid components, the weight of the overall sole structure 900 is reduced. In some embodiments, chambered member 920 may be made from any of the materials previously discussed for chambered member 120 in FIGS. 1-6.

Components from different embodiments may be combined with, or replace, components in other embodiments in order to vary the overall rigidity and/or flexibility of the sole structure. For example, in some embodiments, upper member 910 described in FIG. 9 may be used in place of upper member 810 described in FIG. 8. In such an embodiment, bottom surface 822 of chambered member 820 would be positioned in indentation 831 in the top surface 833 of the intermediate member 830, while the top surface 821 of chambered member 820 would be positioned in indentation 913 on the bottom surface 912 of upper member 910.

Figure 10:
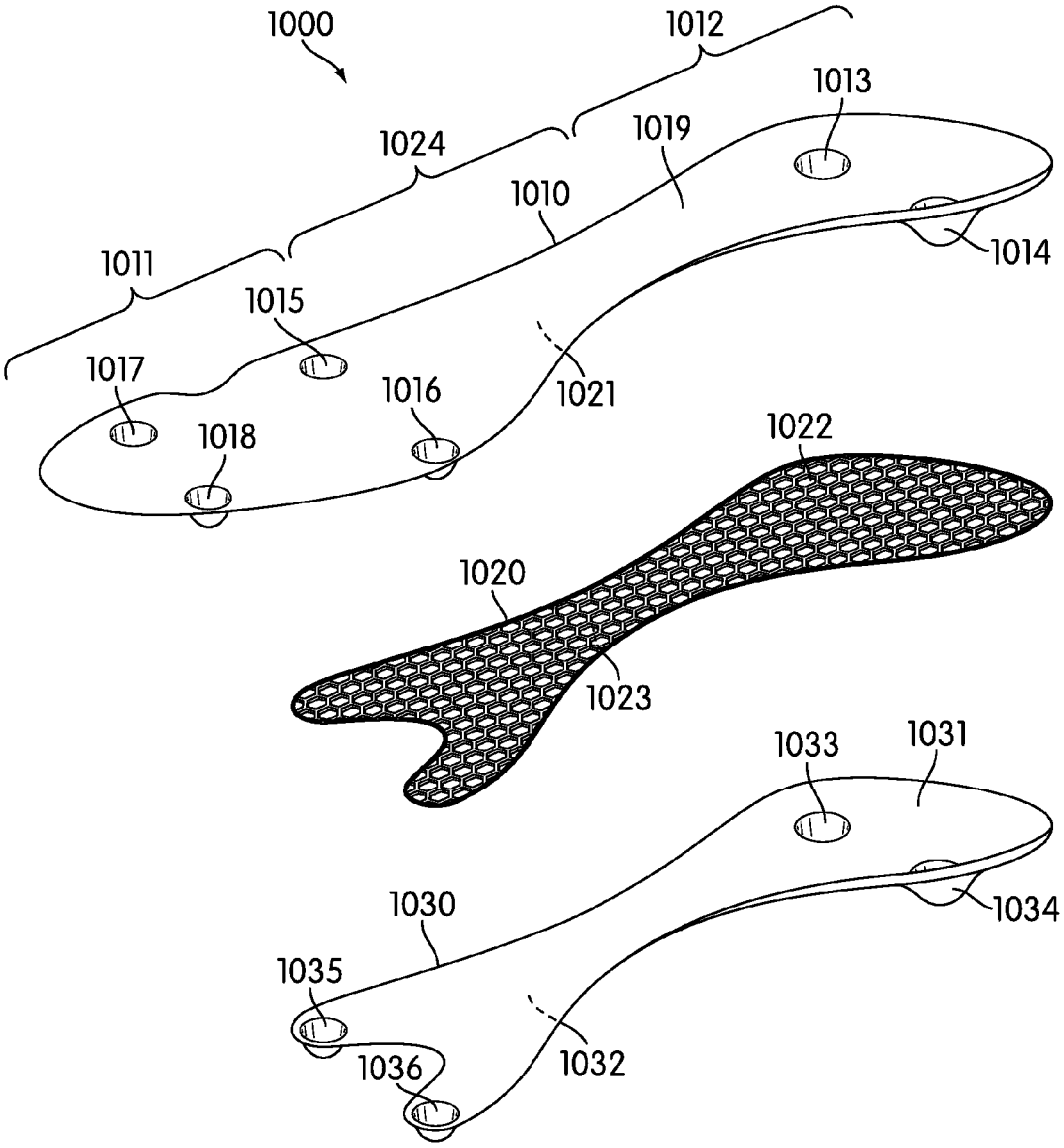
FIG. 10 is an exploded isometric view of another embodiment of a sole structure having a honeycomb layer.

In another embodiment, a sole structure 1000 may include provisions for optimizing the overall weight for varying amounts of desired rigidity. For example, FIG. 10 shows a sole structure 1000 that includes a layer having a honeycomb volume. The embodiment shown in FIG. 10 is similar to the embodiments discussed in FIGS. 1-6, except that the embodiment in FIG. 10 includes a honeycomb layer that is not located within an indentation of another component. Instead, the honeycomb structure forms an additional layer in order to provide lightweight rigidity to the sole structure 1000.

The properties and relationships among the various components described in FIGS. 1-6 also apply to the embodiment shown in FIG. 10. For example, the embodiments described in FIG. 10 may also include a bottom member 140 and cleat tips 150 as discussed in FIGS. 1-6, even though these components are not described in FIG. 10. The embodiments described in FIG. 10 include an upper member 1010, a chambered member 1020 and an intermediate member 1030.

The size, shape and thickness of chambered member 1020 may vary. In some embodiments, as shown in FIG. 10, the chambered member 1020 may have a shape and/or size similar to the shape and/or size of the intermediate member 1030. In other embodiments, the chambered member 1020 may be smaller in size than the intermediate member 1030. In other embodiments, the chambered member 1020 may be larger in size than the intermediate member 1030. In some embodiments, the chambered member may be similar in shape and/or size to the upper member 1010. In some embodiments, the chambered member 1020 may be substantially flat and may have a substantially constant thickness throughout. However, in other embodiments, the chambered member 1020 may have some portions that have a greater thickness than other portions.

The components in FIG. 10 may have similar relationships to one another as the components described in FIGS. 1-6. In some embodiments, the bottom surface 1021 of upper member 1010 may attach to the top surface 1022 of chambered member 1020. In some embodiments, the bottom surface 1023 of chambered member 1020 may attach to the top surface 1031 of intermediate member 1030. In some embodiments, bottom surface 1032 of intermediate member 1030 may attach to a bottom member (not shown in FIG. 10). In some embodiments, upper member 1010, chambered member 1020 and intermediate member 1030 may be made from the same materials, and methods, as previously discussed in FIGS. 1 and 2 for upper member 110, chambered member 120 and intermediate member 130, respectively.

In some embodiments, the size and shape of chambered member 1020 may vary in order to achieve the desired rigidity and/or flexibility. In one embodiment, as shown in FIG. 10, chambered member 1020 may be associated mainly with the midfoot region 1024 of upper member 1010. In other embodiments, chambered member 1020 may be associated with the heel region 1012, midfoot region 1024, and/or forefoot region 1011 of upper member 1010. In some embodiments, chambered member 1020 may be associated with the heel region 1012 and midfoot region 1024 of upper member 1010. In some embodiments, chambered member 1020 may be associated with the midfoot region 1024 and forefoot region 1011 of upper member 1010. In some embodiments, chambered member 1020 may be associated with the heel region 1012 and forefoot region 1011 of upper member 1010.

In some embodiments, chambered member 1020 may be associated with one or more cleat members. For example, in some embodiments chambered member 1020 may include protruding portions (not shown in FIG. 10) corresponding to one or more cleat members. In some embodiments, chambered member 1020 may extend between first protruding portion 1013 in upper member 1010 and first protruding portion 1033 in intermediate member 1030. In some embodiments, chambered member 1020 may extend between second protruding portion 1014 in upper member 1010 and second protruding portion 1034 in intermediate member 1030. In some embodiments, chambered member 1020 may extend between third protruding portion 1015 in upper member 1010 and third protruding portion 1035 in intermediate member 1030. In some embodiments, chambered member 1020 may extend between fourth protruding portion 1016 in upper member 1010 and fourth protruding portion 1036 in intermediate member 1030. In some embodiments, chambered member may be associated with fifth protruding portion 1017 and/or sixth protruding portion 1018 in upper member 1010. In addition, chambered member 1020 may be associated with any cleat member in any embodiment discussed herein. Also, chambered member 1020 may form a layer between any two components in any embodiment discussed herein.

The materials making up the components shown in FIG. 10 may vary in order to provide for rigidity in some areas, while providing for flexibility in other areas. In some embodiments, both upper member 1010 and intermediate member 1030 may be made from carbon or carbon composite. In some embodiments, both upper member 1010 and intermediate member 1030 may be made from glass or glass composite. In some embodiments, upper member 1010 may be made from glass or glass composite and intermediate member 1030 may be made from carbon or carbon composite. In other embodiments, upper member 1010 may be made form carbon or carbon composite and intermediate member 1030 may be made from glass or glass composite. The materials making up the upper member 1010 and intermediate member 1030 may be any of the materials previously discussed for upper member 110 and intermediate member 130, respectively, in FIGS. 1-6.

The structure and make up of the chambered member 1020 may vary. In some embodiments, chambered member 1020 may form a honeycomb volume. In some embodiments, carbon chambered member 1020 having a honeycomb volume may form a lightweight yet rigid layer in sole structure 1000. In some embodiments, chambered member 1020 having a honeycomb volume may add enough rigidity such that the thickness of other components may be reduced. By reducing the thickness of other solid components, the weight of the overall sole structure 1000 is reduced. In some embodiments, chambered member 1020 may be made from any of the materials previously discussed for chambered member 120 in FIGS. 1-6.

The organization of the components shown in FIG. 10 may vary in order to achieve the desired flexibility and/or rigidity. FIG. 10 shows the upper member 1010 located above chambered member 1020 with intermediate member 1030 located below chambered member 1020. However, other embodiments may include upper member 1010 located below chambered member 1020 with intermediate member 1030 located above chambered member 1020. In other embodiments, upper member 1010, chambered member 1020 and bottom member 1030 may be further varied in order to achieve the desired rigidity and/or flexibility.

In some embodiments, provisions may be made for reducing the weight of the sole structure while adjusting the rigidity and/or flexibility. For example, some embodiments may include indentations in more than one component. The indentations of the components may then be aligned and mated during assembly while a chambered member is located in the uppermost member. Since the material making up the chambered member may be less dense than the other components, displacing the material making up the other components with the volume of the chambered member reduces the overall weight of the sole structure. Additionally, the chambered member may increase the overall rigidity of the sole structure in the region where the indentations are located.

Figure 11:
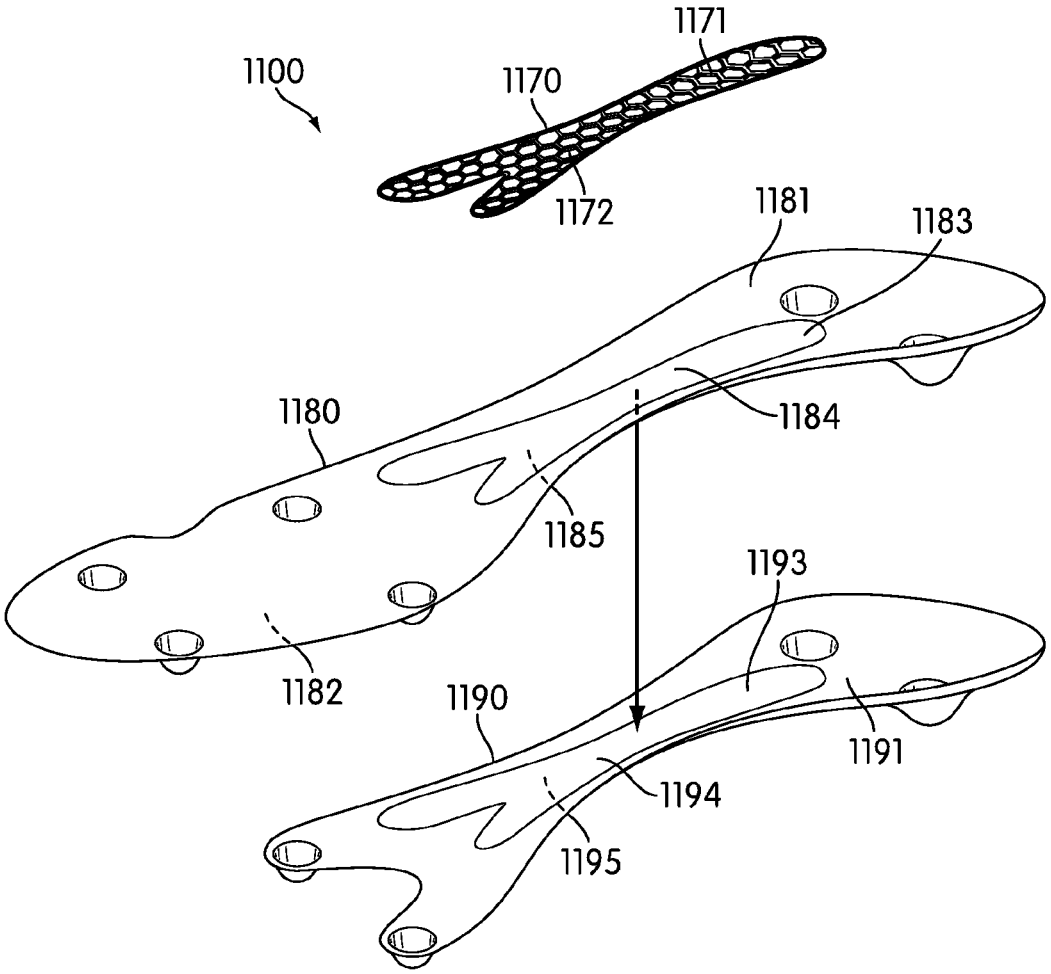
FIG. 11 is an isometric view of one embodiment of a sole structure having two indentations in two components.

Referring to FIG. 11, one embodiment may include a chambered member 1170, an upper member 1180, and an intermediate member 1190. FIG. 11 shows an indentation 1183 in upper member 1180, and an indentation 1193 in intermediate member 1190. During assembly, the top surface 1194 of indentation 1193, located on the top surface 1191 of intermediate member 1190, may be mated with the bottom surface 1185 of indentation 1185, located on the bottom surface 1182 of upper member 1180. Bottom surface 1172 of chambered member 1170 may be located in the top surface 1184 of indentation 1183, located on the top surface 1181 of upper member 1183. In some embodiments, top surface 1171 of chambered member 1170 may be flush with the top surface 1181 of upper member 1180. In other embodiments, top surface 1171 of chambered member 1170 may not be flush with the top surface 1181 of upper member 1180.

The properties and relationships among the various components described in FIGS. 1-6 also apply to the embodiments described in FIG. 11. For example, the embodiments described in FIG. 11 may also include a bottom member 140 and cleat tips 150 as discussed in FIGS. 1-6, even though these components are not described in FIG. 11. In some embodiments, upper member 1180, chambered member 1170 and intermediate member 1190 may be made from the same materials, and methods, as previously discussed in FIGS. 1 and 2 for upper member 110, chambered member 120 and intermediate member 130, respectively.

The materials making up the components shown in FIG. 11 may vary in order to provide for rigidity in some areas, while providing for flexibility in other areas. In some embodiments, both upper member 1110 and intermediate member 1130 may be made from carbon or carbon composite. In some embodiments, both upper member 1110 and intermediate member 1130 may be made from glass or glass composite. In some embodiments, upper member 1110 may be made from glass or glass composite and intermediate member 1130 may be made from carbon or carbon composite. In other embodiments, upper member 1110 may be made form carbon or carbon composite and intermediate member 1130 may be made from glass or glass composite. The materials making up the upper member 910 and intermediate member 1130 may be any of the materials previously discussed for upper member 110 and intermediate member 130, respectively, in FIGS. 1-6.

The structure and make up of the chambered member 1120 may vary. In some embodiments, chambered member 1120 may form a honeycomb volume. In some embodiments, carbon chambered member 1120 having a honeycomb volume may form a lightweight yet rigid layer in sole structure 1100. In some embodiments, chambered member 1120 having a honeycomb volume may add enough rigidity such that the thickness of other components may be reduced. By reducing the thickness of other solid components, the weight of the overall sole structure 1100 is reduced. In some embodiments, chambered member 1120 may be made from any of the materials previously discussed for chambered member 120 in FIGS. 1-6.

In some embodiments, upper member 1180 may be made from glass composite, chambered member 1170 may be made from carbon or carbon composite, and intermediate member 1190 may be made from carbon or carbon composite. In some embodiments, indentation 1183 in top surface 1181 of upper member 1180, indentation 1193 in top surface 1191 of intermediate member 1190, and chambered member 1170, may be Y-shaped. In some embodiments, chambered member 1170 may have a honeycomb volume. In such an embodiment, the rigidity of the sole structure 1100 may be increased in the area of the chambered member 1100 since a portion of the flexible glass composite volume of the upper member 1180 is being replaced by a rigid carbon or carbon composite having a honeycomb volume.

Figure 12:
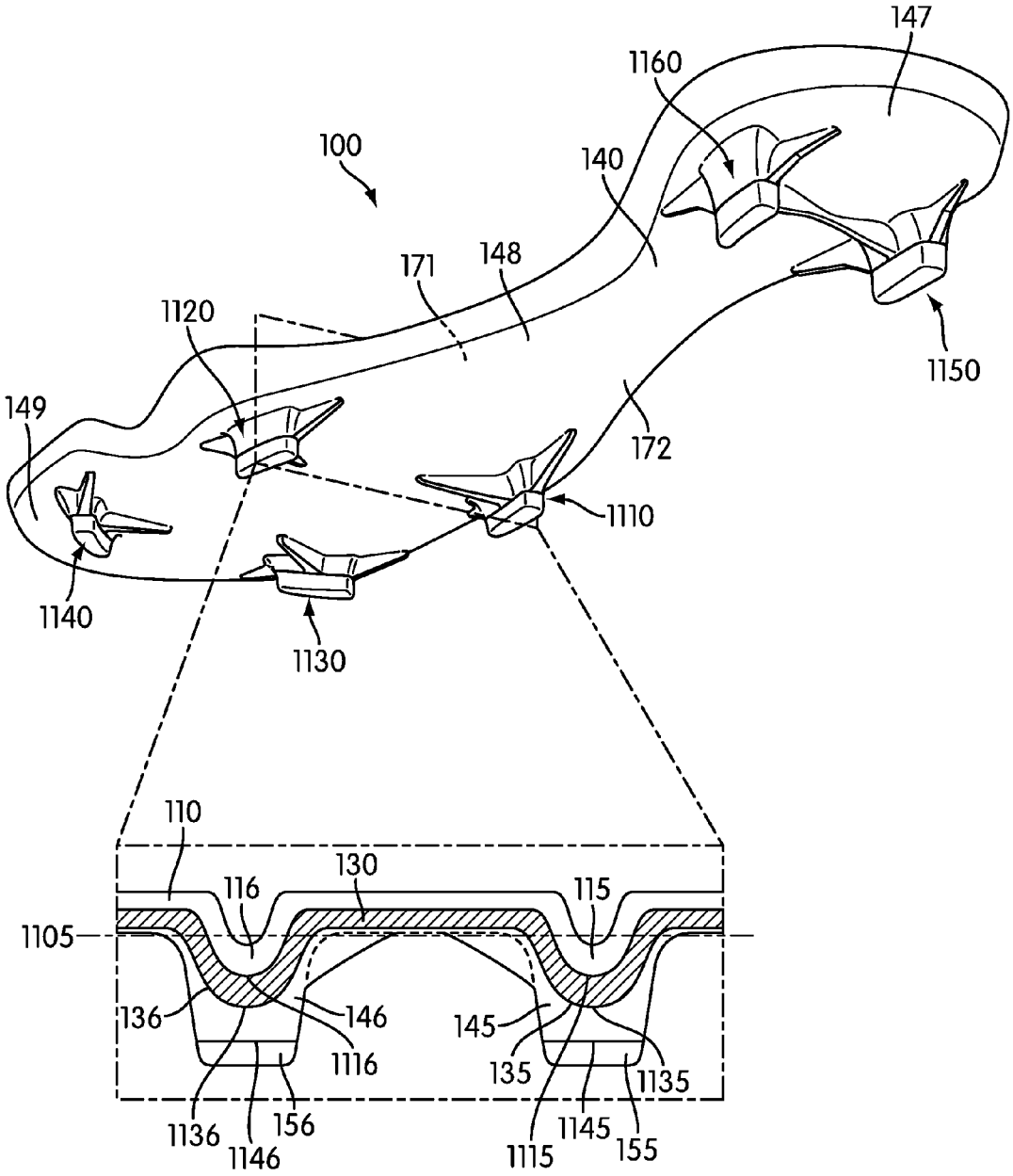
FIG. 12 is a cross-sectional view of one embodiment of a sole structure having cleat members in the forefoot region.

In some embodiments, provisions may be included for providing rigidity to some areas of the sole structure 100, while also providing enough flexibility to allow for twisting and bending. For example, a rigid layer of material may extend into some of the cleat members in the forefoot region in order to provide rigidity there. The rigid layer of material may extend into other areas of the sole structure 100 in order to provide a large surface area capable of absorbing and dissipating impact forces imparted on the cleat members. A flexible layer of material may also extend into the cleat members in order to further absorb and dissipate forces felt on the cleat members and to allow for flexibility in the region. FIG. 12 illustrates one embodiment of cleat members having multiple layers associated with the sole structure 100 described in FIGS. 1-6. In the embodiment shown in FIG. 12, all the components in FIG. 1 have been assembled. As can be seen in FIG. 12, first cleat member 1110, second cleat member 1120, third cleat member 1130 and fourth cleat member 1140 may extend from the bottom surface 172 of the forefoot region 149 of bottom member 140. In some embodiments, fifth cleat member 1150 and sixth cleat member 1160 may extend from the bottom surface 172 of the heel region 147 of bottom member 140.

In some embodiments, a portion of the cleat member may be designed to penetrate into the ground surface. The term "penetrating portion" as used throughout this detailed description and in the claims refers to any portion of a cleat member that is configured to penetrate into a ground surface. In some embodiments, penetrating portions may provide traction between the sole structure 100 and the ground surface. In some embodiments, a portion of the first cleat member 1110, second cleat member 1120, third cleat member 1130, fourth cleat member 1140, fifth cleat member 1150 and/or sixth cleat member 1160 may form a penetrating portion. For example, as seen in FIG. 12, the ground penetrating portion of first cleat member 1110 includes protruding portion 145 of bottom member 140, protruding portion 135 of intermediate member 130 and protruding portion 115 of upper member 110. Likewise, the ground penetrating portion of second cleat member 1120 includes protruding portion 146 of bottom member 140, protruding portion 136 of intermediate member 130 and protruding portion 116 of upper member 110.

In some embodiments, cleat members may include one or more layers of materials in order to achieve the desired rigidity and/or flexibility. FIG. 12 shows a cross-sectional view of first cleat member 1110 and second cleat member 1120. Referencing FIG. 12, first cleat member 1110 may be associated with third protruding portion 115 in upper member 110, third protruding portion 135 in intermediate member 130, and third protruding portion 145 in bottom member 140. Similarly, second cleat member 1120 may be associated with fourth protruding portion 116 in upper member 110, fourth protruding portion 136 in intermediate member 130, and fourth protruding portion 146 in bottom member 140. In some embodiments, each of these protruding portions may form a dome-like shape in such a way as to cooperate with one another. However, in some embodiments, the protruding portions may have different shapes from one another. In some embodiments, fourth protruding portion 116 in upper member 110 and fourth protruding portion 136 in intermediate member 130 may form a dome-like shape, while fourth protruding portion 146 may have a flat tip 1146 in order to mate with cleat tip 156. Likewise, third protruding portion 115 in upper member 110 and third protruding portion 135 in intermediate member 130 may form a dome-like shape, while third protruding portion 145 in bottom member 140 may have a flat tip 1146 in order to mate with cleat tip 155. Cleat tip 155 may be attached to the outer surface of the third protruding portion 145 formed on the bottom surface 172 of bottom member 140. Similarly, cleat tip 156 may be attached to the outer surface of the fourth protruding portion 146 on the bottom surface 172 of bottom member 140.

It will be understood that while the current embodiments use elongated and/or rectangular shaped cleat members, cleat members may be formed in any of various shapes, including but not limited to: hexagonal, cylindrical, conical, conical frustum, round, circular, square, rectangular, rectangular frustum, trapezoidal, diamond, ovoid, as well as any other shape known to those in the art.

In some embodiments the length of the cleat members may vary. For example, in some embodiments, cleat members may extend further into the ground in order to increase traction. In other embodiments, cleat members may extend less into the ground in order to improve the wearer's ability to change directions quickly.

In some embodiments, longer cleat members may be desired. FIG. 12 illustrates a possible relationship between first cleat member 1110, second cleat member 1120, and plane 1105. For example, the apex of each protruding portion in each layer of each cleat member may extend beyond plane 1105 of the outer bottom surface 172 of the bottom member 140.

Referring to FIG. 12, each layer of second cleat member 1120 may extend beyond plane 1105 of the outer bottom surface 172 of the bottom member 140. In some embodiments, apex 1116 of fourth protruding portion 116 in upper member 110, apex 1136 of fourth protruding portion 136 in intermediate member 130, and apex 1146 of fourth protruding portion 146 in bottom member 140 may extend outwardly beyond plane 1105.

In other embodiments, not every layer of second cleat member 1120 extends beyond plane 1105. In some embodiments, apex 1146 of fourth protruding portion 146 in bottom member 140 may extend outwardly beyond plane 1105, while apex 1136 of fourth protruding portion 136 in intermediate member 130 and apex 1116 of fourth protruding portion 116 in upper member 110 do not extend beyond plane 1105. In some embodiments, apex 1146 of fourth protruding portion 146 in bottom member 140 and apex 1136 of fourth protruding portion 136 in intermediate member 130 may extend outwardly beyond plane 1105, while apex 1116 of fourth protruding portion 116 in upper member 110 does not extend beyond plane 1105. In another embodiment, apex 1146, apex 1136 and apex 1116 do not extend beyond plane 1105.

First cleat member 1110 may have a similar relationship with plane 1105. In some embodiments, apex 1115 of third protruding portion 115 in upper member 110, apex 1135 of third protruding portion 135 in intermediate member 130, and apex 1145 of third protruding portion 145 in bottom member 140 may extend outwardly beyond plane 1105.

In other embodiments, not every layer of first cleat member 1110 extends beyond plane 1105. In some embodiments, apex 1145 of third protruding portion 145 may extend outwardly beyond plane 1105, while apex 1135 of third protruding portion 135 in intermediate member 130 and apex 1115 of third protruding portion 115 in upper member 110 do not extend beyond plane 1105. In some embodiments, apex 1145 of third protruding portion 145 in bottom member 140 and apex 1135 of third protruding portion 135 in intermediate member 130 may extend outwardly beyond plane 1105, while apex 1115 of third protruding portion 115 in upper member 110 does not extend beyond plane 1105. In another embodiment, apex 1145, apex 1135 and apex 1115 do not extend beyond plane 1105.

Third cleat member 1130 and fourth cleat member 1140, located on the forefoot region 149 of the bottom surface 172 of bottom member 140, may also include similar properties and relationships as discussed in FIG. 12 for first cleat member 1110 and second cleat member 1120. Although FIG. 12 shows only four cleat members associated with the forefoot region 149 of bottom surface 140, other embodiments may include more or less cleat members in the forefoot region 149. Additionally, fifth cleat member 1150 and sixth cleat member 1160 located in the heel region 147 of the bottom surface 172 of bottom member 140, may include similar properties and relationships as discussed in FIG. 12 for first cleat member 1110 and second cleat member 1120.

Although the embodiments discussed in FIG. 12 include cleat members having an upper member 110, an intermediate member 130, a bottom member 140 and cleat tips 150, other embodiments may include varying layers associated with the cleat members. In some embodiments, cleat members may include layers arranged in a different order than that described in FIG. 12. For example, in some embodiments cleat members may include layers as described in FIGS. 7-11. In some embodiments, cleat members may include a chambered member 1020, as described in the embodiment disclosed in FIG. 10. The details and relationships discussed in FIG. 12 may also be applied to any other embodiment discussed in FIGS. 1-11.

Figure 13:
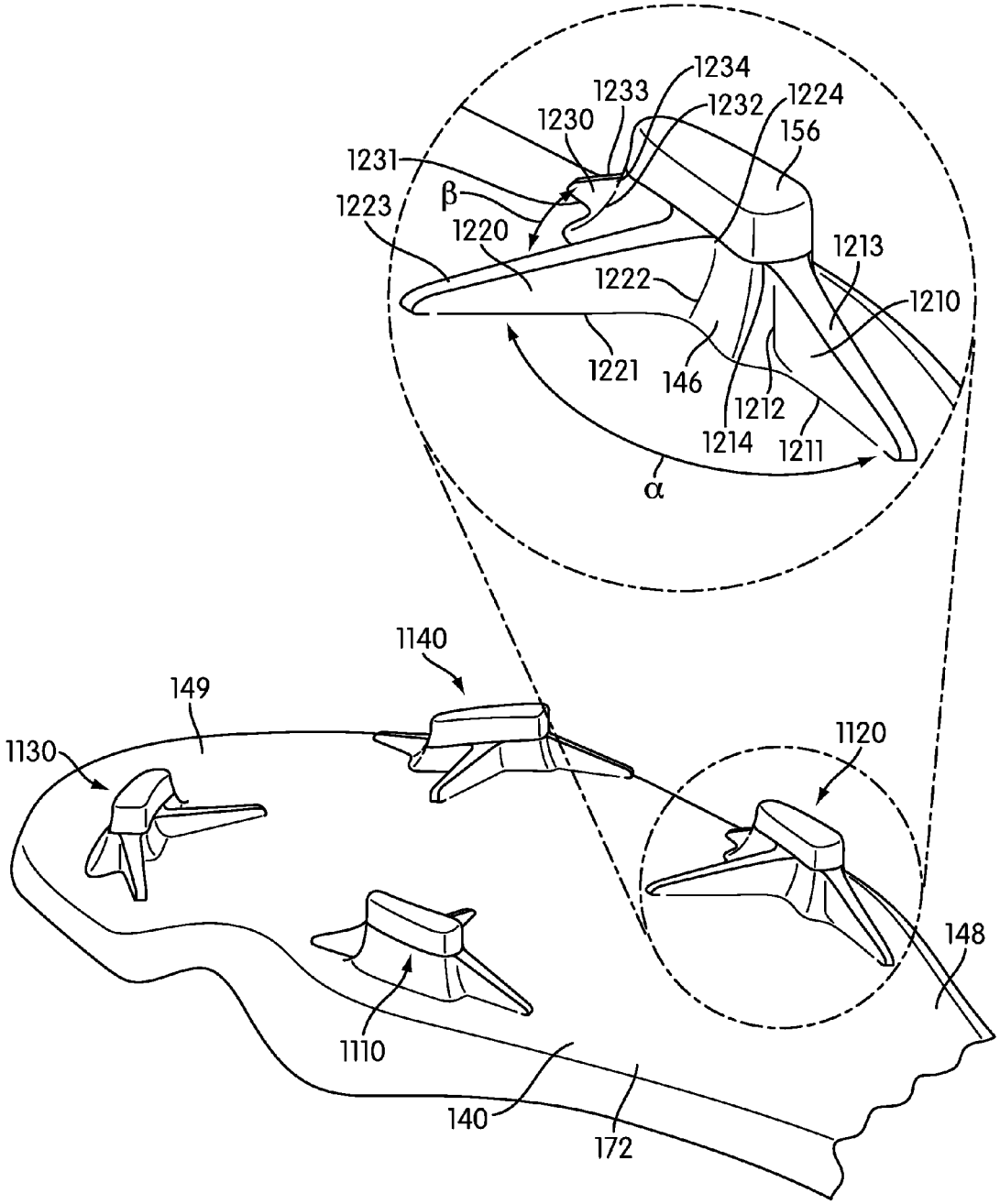
FIG. 13 is an isometric view of one embodiment of a sole structure having cleat members in the forefoot region.

In some embodiments, provisions may be included to further support the cleat members. In some embodiments, as shown in FIG. 13, blade-like projections may abut and support each cleat member in the forefoot region 149. FIG. 13 shows one embodiment of the forefoot region 149 of the bottom surface 172 of the bottom member 140. FIG. 13 also shows an enlarged isometric view of second cleat member 1120, which may include a first blade-like projection 1210, second blade-like projection 1220 and third blade-like projection 1230.

Some embodiments may include a first blade-like projection 1210. The first blade-like projection 1210 may have a first edge 1211, a second edge 1212 and a third edge 1213. The first edge 1211 may be attached to the bottom surface 172 of bottom member 140. The second edge 1212 may be attached to at least a portion of fourth protruding portion 146. The third edge 1213 may slope from the top corner 1214 of the second edge 1212 to the bottom surface 172 of bottom member 140. In some embodiments, third edge 1213 may form a straight line between top corner 1214 of the second edge 1212 and the bottom surface 172 of bottom member 140. In other embodiments, the third edge 1213 may be curved, or form an arc.

Some embodiments may include a second blade-like projection 1220. The second blade-like projection 1220 has a first edge 1221, a second edge 1222 and a third edge 1223. The first edge 1221 is attached to the bottom surface 172 of bottom member 140. The second edge 1222 is attached to at least a portion of fourth protruding portion 146. The third edge 1223 slopes from the top corner 1224 of the second edge 1222 to the bottom surface 172 of bottom member 140. In some embodiments, third edge 1223 may form a straight line between top corner 1224 of the second edge 1222 and the bottom surface 172 of bottom member 140. In other embodiments, third edge 1223 may be curved, or form an arc.

In some embodiments, the first blade-like projection 1210 may extend away from fourth protruding portion 146 at an angle alpha ($\alpha$) in relation to the second blade-like projection 1220. In some embodiments, $\alpha$ may be substantially equal to 90°. In other embodiments, $\alpha$ may be greater than or less than 90°. For example, in some embodiments, a is substantially equal to 80°. In another embodiment, $\alpha$ is substantially equal to 100°.

Some embodiments may include a third blade-like projection 1230. The third blade-like projection 1230 has a first edge 1231, a second edge 1232 and a third edge 1233. The first edge 1221 is attached to the bottom surface 172 of bottom member 140. The second edge 1232 is attached to at least a portion of fourth protruding portion 146. The third edge 1233 slopes from the top corner 1234 of the second edge 1232 to the bottom surface 172 of bottom member 140. In some embodiments, third edge 1233 may form a straight line between top corner 1234 of the second edge 1232 and the bottom surface 172 of bottom member 140. In other embodiments, third edge 1233 may be curved, or form an arc.

In some embodiments, the third blade-like projection 1230 may extend away from fourth protruding portion 146 at an angle beta ($\beta$) in relation to the second blade-like projection 1220. In some embodiments, $\beta$ may be substantially equal to 90°. In other embodiments, $\beta$ may be greater than or less than 90°. For example, in some embodiments, $\beta$ is substantially equal to 80°. In another embodiment, $\beta$ is substantially equal to 100°.

Although FIG. 13 illustrates a cleat member having three blade-like projections, some embodiments may include more or less blade-like projections. The blade-like projections provide the wearer with improved push off capabilities. In addition, the blade-like projections allow the wearer to more easily change directions since a larger surface area contacts the ground when pushing off. Although FIG. 13 illustrates blade-like projections for cleat members in the forefoot region 149, cleat members in the midfoot region 148 and heel region 147 may also include blade-like projections as discussed in FIG. 13.

Figure 14:
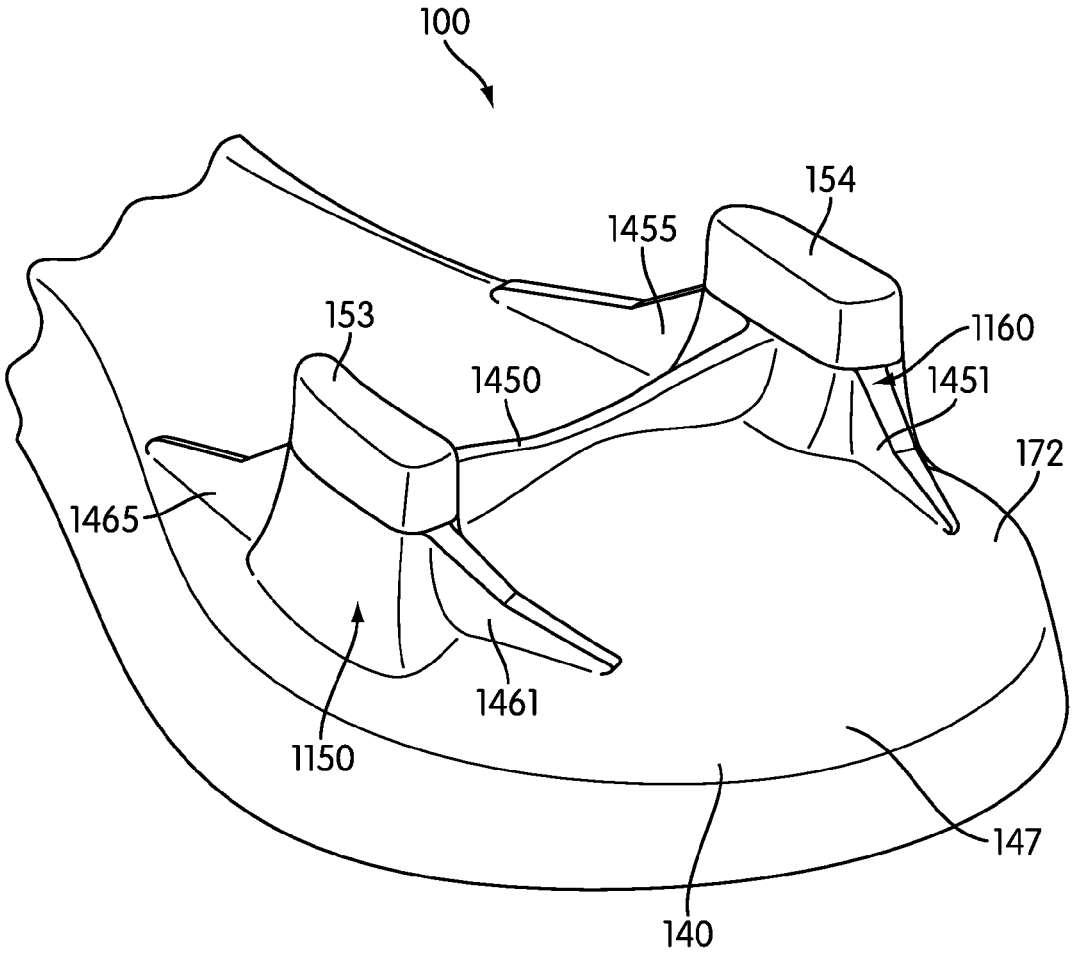
FIG. 14 is an isometric view of one embodiment of a sole structure having cleat members in the heel region.

Cleat members in the heel region 147 may also include blade-like projections. FIG. 14 illustrates an enlarged isometric perspective of cleat member 1150 and cleat member 1160 in the heel region 147 of bottom member 140. Referring to FIG. 14, cleat member 1150 includes first blade-like projection 1451, second blade-like projection 1450 and third blade-like projection 1455 extending outwardly from the bottom surface 172 of bottom member 140. First blade-like projection 1451, second blade-like projection 1450 and third blade-like projection 1455 abut and support cleat member 1160 and have a similar relationship with cleat member 1160 as the relationship between second cleat member 1120 and first blade-like projection 1210, second blade-like projection 1220 and third blade-like projection 1230 discussed in FIG. 13. Similarly, cleat member 1150 includes first blade-like projection 1461, second blade-like projection 1450 and third blade-like projection 1465 extending outwardly from the bottom surface 172 of bottom member 140. First blade-like projection 1461, second blade-like projection 1450 and third blade-like projection 1465 abut and support cleat member 1150 and have a similar relationship with cleat member 1150 as the relationship between second cleat member 1120 and first blade-like projection 1210, second blade-like projection 1220 and third blade-like projection 1230 described and discussed in FIG. 13.

In some embodiments, second blade-like projection 1450 may form one lateral projection between cleat member 1160 and cleat member 1150. Forming one lateral projection would increase push-off capability of the wearer and enhance the wearer's capability to change directions.

Figure 15:
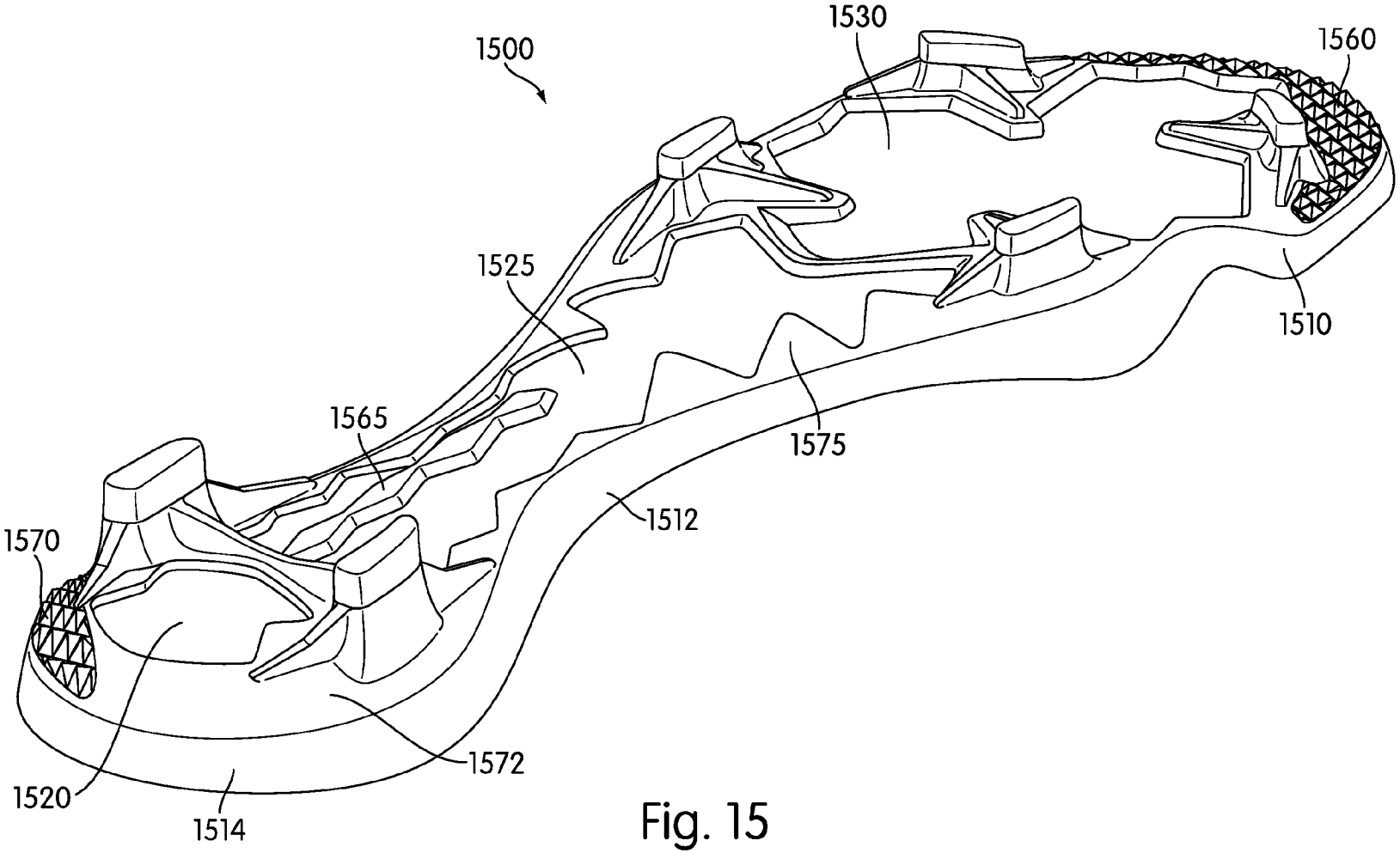
FIG. 15 is an isometric view of another embodiment of a bottom member of a sole structure.

In some embodiments, provisions may be made for including additional features on the bottom member in order to reduce the weight of the sole structure and/or to improve traction. The embodiments described in FIG. 15 may be associated with any embodiment discussed in FIGS. 1-14. The embodiments described in FIG. 15 may include similar properties and relationships as those discussed in FIGS. 1-14. Referring to FIG. 15, one embodiment of a bottom member 1500 may include a heel region 1514, midfoot region 1512 and a forefoot region 1510.

In some embodiments, provisions may be included on bottom member 1500 in order to increase the traction between the wearer's foot and the ground surface. In some embodiments, bottom member 1500 may include a plurality of individual projections forming a first textured region 1570 on the bottom surface 1572 of the heel region 1514 of bottom member 1500. The first textured region 1572 provides for additional traction and enhances the wearer's ability to change directions.

In some embodiments, the shape of the individual projections in first textured region 1570 may vary. In some embodiments, the projections may be triangular or pyramid shaped. In other embodiments, the projections could have any other shape having a point.

In different embodiments, a textured region could be formed in any manner. In some embodiments, first textured region 1570 may be formed when molding the bottom member 1500. In some embodiments, first textured region 1570 may be formed by cutting the formation after molding, such as by a waterjet or laser.

In some embodiments, bottom member 1500 may include a plurality of projections forming a second textured region 1560 on the bottom surface 1572 of the forefoot region 1510 of bottom member 1500. The second textured region 1560 provides for additional traction and enhances the wearer's ability to change directions. In some cases, the projections of second textured region 1560 may be substantially similar to the projections of first textured region 1570.

In some embodiments, provisions may be included to reduce the weight of bottom member 1500. In some embodiments, openings may be made in portions of bottom member in order to reduce the overall weight of bottom member 1500. In some embodiments, a heel opening 1520 may be included in the heel region 1514 of bottom member 1500. In some embodiments, a midfoot opening 1525 may be included in the midfoot region 1512 of bottom member 1500. In some embodiments, a forefoot opening 1530 may be included in the forefoot region 1510 of bottom member 1500.

In some embodiments, provisions may be included to increase the rigidity of bottom member 1500. In some embodiments, bottom member 1500 may include a spinal structure 1565 associated with the bottom surface 1572. In some embodiments, spinal structure 1565 may include a series of diamond and/or triangular shaped structures running in the direction of the heel region 1514 to the forefoot region 1510. The spinal structure 1565 may provide additional structural support to bottom surface 1572 of bottom member 1500.

In some embodiments, the shape of the individual structures of making up the spinal structure 1565 may vary. In some embodiments, the spinal structure 1565 may be made from a series of square-shaped structures. In some embodiments, the spinal structure 1565 may be made from any other shape of individual structures.

In some embodiments, the location of the spinal structure 1565 may vary. In some embodiments, as shown in FIG. 15, the spinal structure 1565 may run in a longitudinal direction in the center of the midfoot opening 1525 of bottom member 1500. However, in other embodiments, the spinal structure 1565 may extend in a longitudinal or lateral direction in any of the openings in the bottom member 1500. In still further embodiments, the spinal structure 1565 may extend in a longitudinal direction on the bottom surface 1572 of bottom member 1500. In still further embodiments, spinal structure 1565 may be associated with any portion of the bottom member 1500 in order to increase the rigidity of the bottom member 1500.

While various embodiments of the have been described, the description is intended to be exemplary, rather than limiting and it will be apparent to those in the art that many more embodiments and implementations are possible that are within the scope of the current embodiments. Accordingly, the embodiments are not to be restricted except in light of the attached claims and their equivalents. Also, various modifications and changes may be made within the scope of the attached claims.

What is claimed is:

1. A sole structure comprising:

an upper plate member having a top surface and a bottom surface, the upper plate member having a concave indentation in the bottom surface;

a chambered member having a top surface and a bottom surface, the chambered member comprising a plurality of geometrically-shaped columns forming chambers, the chambered member being inserted within the concave indentation in the bottom surface of the upper plate member; and an intermediate plate member having a top surface and a bottom surface, wherein the bottom surface of the chambered member overlies the top surface of the intermediate plate member.

2. The sole structure of claim 1, wherein the upper plate member has a first length and the intermediate plate member has a second length, wherein the first length is greater than the second length.

3. The sole structure of claim 1, further comprising a bottom plate member having a top surface, wherein the bottom surface of the intermediate plate member overlies the top surface of the bottom plate member.

4. The sole structure of claim 1, wherein the intermediate plate member and the upper plate member are made from carbon composites.

5. The sole structure of claim 1, wherein the intermediate plate member and the upper plate member are made from glass composites.

6. The sole structure of claim 1, wherein the chambered member is formed by injecting a material into the indentation of the upper plate member.

7. The sole structure of claim 1, wherein the bottom surface of the upper plate member is attached to the top surface of the intermediate plate member.

8. A sole structure comprising:

an upper plate member having a top surface, bottom surface, a forefoot region, a midfoot region, and a heel region;

a chambered member having a top surface and a bottom surface, the chambered member comprising a plurality of geometrically-shaped columns forming chambers; and an intermediate plate member having a top surface and a bottom surface, wherein the intermediate plate member and the chambered member are coextensive with each other;

a bottom plate member having a top surface and a bottom surface, a forefoot region, a midfoot region, and a heel region, wherein the bottom surface of the intermediate plate member overlies the top surface of the bottom plate member; and wherein the forefoot region of the bottom plate member has a first protruding portion being formed by a depression in the top surface of the bottom plate member and a corresponding protrusion formed in the bottom surface of the bottom plate member.

9. The sole structure according to claim 8, wherein the upper plate member has first length and the intermediate plate member has a second length, wherein the first length is greater than the second length.

10. The sole structure according to claim 8, wherein the chambered member separates the upper plate member from the intermediate plate member.

11. The sole structure according to claim 8, wherein the chambered member has a substantially constant thickness.

12. The sole structure of claim 8, wherein the intermediate plate member has a second protruding portion extending from the bottom surface of the intermediate plate member.

13. The sole structure of claim 12, wherein the second protruding portion in the bottom surface of the intermediate plate member nests within the depression in the top surface of the bottom plate member.

14. The sole structure of claim 13, wherein a cleat tip is disposed on the bottom surface of the bottom plate member in the forefoot region of the bottom plate member corresponding to the first protruding portion of the bottom plate member.

15. A sole structure comprising:

a bottom plate member having a top surface, a bottom surface, a forefoot region, a midfoot region, and a heel region, wherein the forefoot region of the bottom plate member has first protruding portion being formed by a depression in the top surface of the bottom plate member and a corresponding protrusion formed in the bottom surface of the bottom plate member;

an intermediate plate member overlying the bottom plate member, the intermediate plate member being more rigid than the bottom plate member, and having a top surface and a bottom surface, a forefoot region, a midfoot region, and a heel region, and a second protruding portion extending from the bottom surface of the intermediate plate member, the second protruding portion having an apex;

an upper plate member having a top surface, a bottom surface, and a concave indentation in the bottom surface of the upper plate member; and a chambered member having a top surface and a bottom surface, the chambered member comprising a plurality of geometrically-shaped columns forming chambers, and the chambered member being inserted within the concave indentation in the bottom surface of the upper plate member;

wherein the second protruding portion of the bottom surface of the intermediate plate member nests within the first protruding portion in the top surface of the bottom plate member such that the apex of the second protruding portion rests against a surface of the depression of the first protruding portion; and wherein the bottom surface of the chambered member overlies the top surface of the intermediate plate member.

16. The sole structure of claim 15, wherein the upper plate member has a first length and the intermediate plate member has a second length, wherein the first length is greater than the second length.

17. The sole structure of claim 15, wherein the intermediate plate member and the upper plate member are made from materials having fibers.

18. The sole structure according to claim 15, wherein the chambered member has a substantially constant thickness.

* * * * *